US010857587B2

(12) United States Patent
Morijiri et al.

(10) Patent No.: US 10,857,587 B2
(45) Date of Patent: Dec. 8, 2020

(54) BINDING MACHINE AND AUXILIARY MEMBER FOR BINDING MACHINE

(71) Applicant: MAX CO., LTD., Chuo-ku, Tokyo (JP)

(72) Inventors: Takeshi Morijiri, Tokyo (JP); Takanori Ban, Tokyo (JP)

(73) Assignee: MAX CO., LTD., Tokyo (JP)

( * ) Notice: Subject to any disclaimer, the term of this patent is extended or adjusted under 35 U.S.C. 154(b) by 303 days.

(21) Appl. No.: 15/807,787

(22) Filed: Nov. 9, 2017

(65) Prior Publication Data

US 2018/0126443 A1 May 10, 2018

(30) Foreign Application Priority Data

Nov. 10, 2016 (JP) ..... 2016-219784

(51) Int. Cl.
*B21F 15/04* (2006.01)
*B65B 13/02* (2006.01)
*E04G 21/12* (2006.01)

(52) U.S. Cl.
CPC ..... *B21F 15/04* (2013.01); *B65B 13/025* (2013.01); *E04G 21/122* (2013.01); *E04G 21/123* (2013.01)

(58) Field of Classification Search
CPC ..... B65B 13/06; B65B 13/18; B65B 13/04; B65B 13/28; B65B 13/285; B65B 27/06; B65B 13/025; E04G 21/122; E04G 21/123; B21F 15/04
See application file for complete search history.

(56) References Cited

U.S. PATENT DOCUMENTS 3,810,495 A * 5/1974 Pack ..... E04G 21/122 140/93 A
5,000,233 A * 3/1991 Oetiker ..... B23P 19/086 140/150
5,217,049 A 6/1993 Forsyth
5,279,336 A 1/1994 Kusakari et al.
5,558,012 A * 9/1996 Yamashima ..... B65B 13/28 100/26
5,558,134 A 9/1996 Miyazaki
5,956,989 A * 9/1999 Kusakari ..... E04G 21/123 72/119
5,983,473 A 11/1999 Yuguchi et al.
8,033,303 B2 * 10/2011 Kusakari ..... E04G 21/123 140/119

(Continued)

FOREIGN PATENT DOCUMENTS

CN 1271801 A 11/2000
CN 204846443 U 12/2015

(Continued)

OTHER PUBLICATIONS

Extended European Search Report dated Feb. 19, 2018 in corresponding European patent application 17200825.2 (8 pages).

(Continued)

*Primary Examiner* — Pradeep C Battula
(74) *Attorney, Agent, or Firm* — Rothwell, Figg, Ernst & Manbeck P.C.

(57) ABSTRACT

A binding machine includes a curl guide configured to guide a wire in a loop shape around a binding target and a twisting part configured to bind the binding target by twisting the wire guided in the loop shape around the binding target. The curl guide has a tapered protrusion at a tip end-side.

18 Claims, 22 Drawing Sheets

(56) References Cited

U.S. PATENT DOCUMENTS

2009/0283168 A1 11/2009 Kusakari

FOREIGN PATENT DOCUMENTS

| | | | |
|---|---|---|---|
| EP | 1775400 | A1 | 4/2007 |
| EP | 2123849 | A1 | 11/2009 |
| JP | S63-191719 | A | 8/1988 |
| JP | 05-92103 | U | 12/1993 |
| JP | H07-132914 | A | 5/1995 |
| JP | H07-275983 | A | 10/1995 |
| JP | 12000-064617 | A | 2/2000 |
| JP | 5126101 | B2 | 1/2013 |
| WO | WO-2007-141822 | A1 | 12/2007 |

OTHER PUBLICATIONS

Office Action issued for Japanese Patent Application No. 2016-219784 dated Jul. 21, 2020, (6 pages).

* cited by examiner

BINDING MACHINE AND AUXILIARY MEMBER FOR BINDING MACHINE

CROSS-REFERENCE TO RELATED APPLICATION

This application claims priority from Japanese patent application No. 2016-219784 filed on Nov. 10, 2016, the entire contents of which are incorporated herein by reference.

TECHNICAL FIELD

The disclosure relates to a binding machine and an auxiliary member for binding machine.

BACKGROUND

For example, a binding machine is used to bind a binding target such as reinforcing bars at a construction site (refer to Patent Document 1: Japanese Patent No. 5,126,101B).

When the binding machine is used, since it is possible to securely speed up an operation, it is expected that the spread of the binding machine will be increased.

The binding machine has a curl guide configured to guide a wire in a loop shape around the binding target.

However, according to the binding machine of the related art, when binding the binding target put on a ground, for example, it takes time because it is necessary to lift the binding target put on the ground with a hand opposite a hand holding the binding machine.

SUMMARY

It is therefore an object of the disclosure to mainly solve the above problem.

In order to solve the above problem, the disclosure provides a binding machine including a curl guide configured to guide a wire in a loop shape around a binding target, and a twisting part configured to bind the binding target by twisting the wire guided in the loop shape around the binding target, wherein the curl guide has a tapered protrusion at a tip end-side.

According to the disclosure, since the tapered protrusion is provided at the tip end-side of the curl guide, it is possible to scoop up (lift) the binding target put on a ground, for example. Therefore, when binding the binding target, it is possible to omit the labor of lifting the binding target with a hand opposite to a hand carrying the binding machine.

DETAILED DESCRIPTION

Hereinafter, embodiments will be described in detail with reference to the drawings. FIGS. 1 to 25C depict the embodiments.

Embodiment 1

<Configuration>

In the below, a configuration of the embodiment is described.

Figure 1:
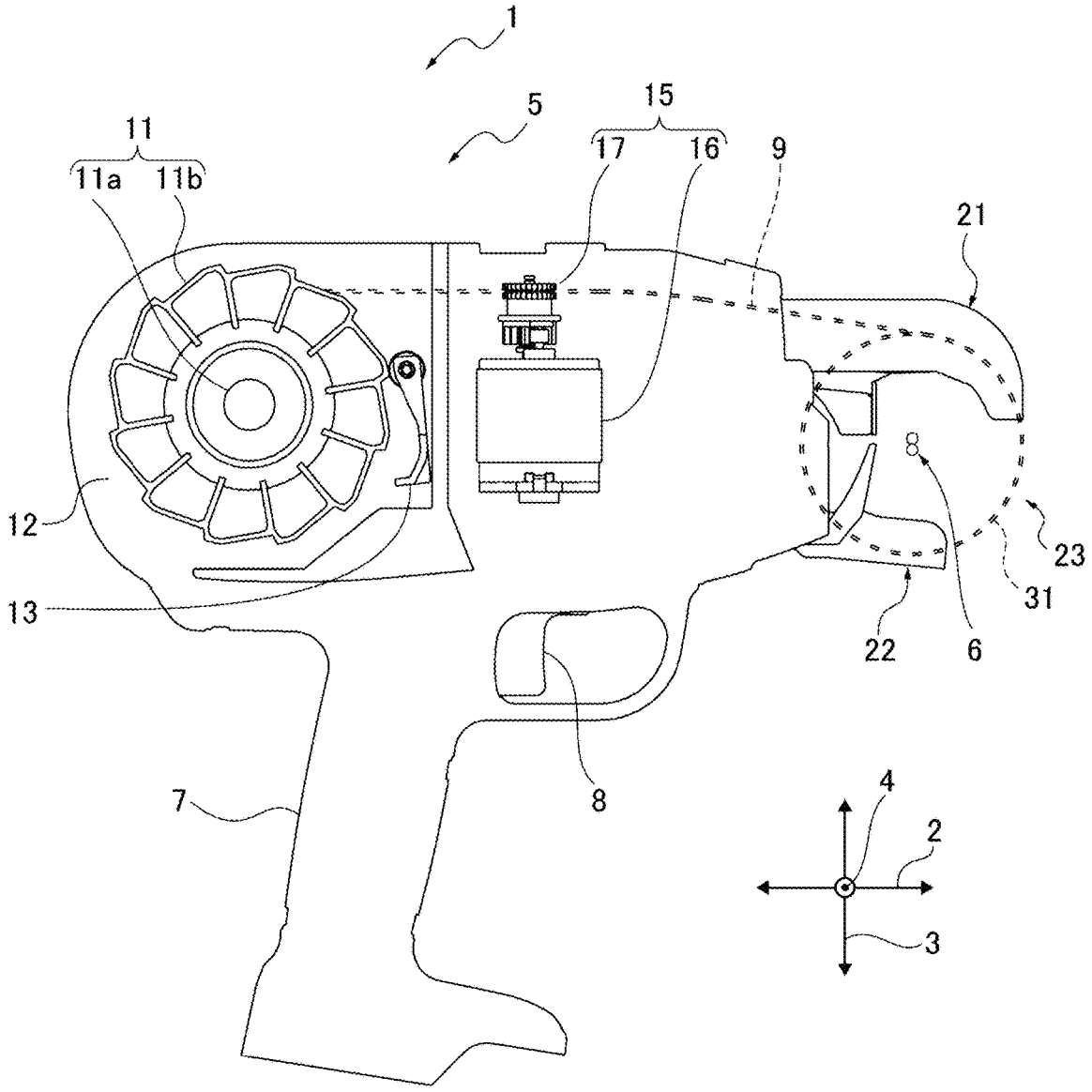
FIG. 1 is a right side view of a binding machine before mounting an auxiliary member for binding machine of an embodiment.

FIG. 1 depicts a binding machine 1. In FIG. 1, arrows indicate a front and back direction 2, a height direction 3, and a width direction 4 of the binding machine 1. A direction in which a main body (binding machine main body 5) of the binding machine 1 extends is the front and back direction 2. A side of the binding machine 1 facing toward the binding target 6 is a front side of the front and back direction 2. In FIG. 1, the height direction 3 is an upper and lower direction. The width direction 4 is a direction perpendicular to the drawing sheet. An intermediate part of the binding machine main body 5 in the front and back direction 2 is provided with a gripping part (grip) 7 substantially extending downward. An upper part of the gripping part 7 is provided with a trigger switch 8. When the trigger switch 8 is pulled at a state where a power supply is ON, the binding machine 1 is operated.

A wire 9 for binding the binding target 6 is wound on a reel (wire reel) 11. The reel 11 has a shaft part 11*a*, and flange parts 11*b* provided at both end portions of the shaft part 11*a* in the width direction 4.

A rear part of the binding machine main body 5 is provided with a mounting part (a reel mounting part) 12 capable of rotatably mounting the reel 11 thereto. However, a position of the mounting part 12 is not limited to the rear part of the binding machine main body 5. The mounting part 12 is provided with a brake member 13 configured to restrain rotation of the reel 11. The brake member 13 is configured to brake the rotation of the reel 11 at a time point at which the feeding of the wire 9 ends, for example. In this case, the flange parts 11*b* of the reel 11 are configured as a ratchet gear and the brake member 13 is configured as a claw part to be meshed with the ratchet gear, so that the rotation of the reel 11 in one direction (a direction in which the wire 9 is to be pulled out) and reverse rotation thereof by one tooth of the ratchet gear are allowed.

The wire 9 pulled out from the reel 11 mounted to the mounting part 12 is sent to a front side of the binding machine main body 5 by a wire feeding part (a wire feeding mechanism) 15. The wire feeding part 15 includes an electric motor (a feeding motor) 16 and feeding rollers 17 to be driven by the electric motor 16. The feeding rollers 17 are configured by a pair of right and left feeding gears having a gear shape. The wire 9 is sent forward by rotations of the pair of feeding rollers 17 at a state where the wire has passed between the pair of feeding rollers 17.

A front end portion of the binding machine main body 5 is provided with curl guides 21, 22 configured to curl the wire 9 and to guide the same in a loop shape around the binding target 6. The wire 9 is enabled to circulate one or more times around the binding target 6 by the curl guides 21, 22.

The curl guides 21, 22 are provided as a pair with an interval in the height direction 3 (the upper and lower direction). An opening (insertion part) 23 for inserting therein the binding target 6 is formed with an interval between tip end portions of the pair of upper and lower curl guides 21, 22. The upper curl guide 21 is a fixed curl guide. The lower curl guide 22 may be fixed or moveable. In the embodiment, the lower curl guide 22 is configured as a moveable curl guide. The curl guides 21, 22 will be described later.

Figure 2:
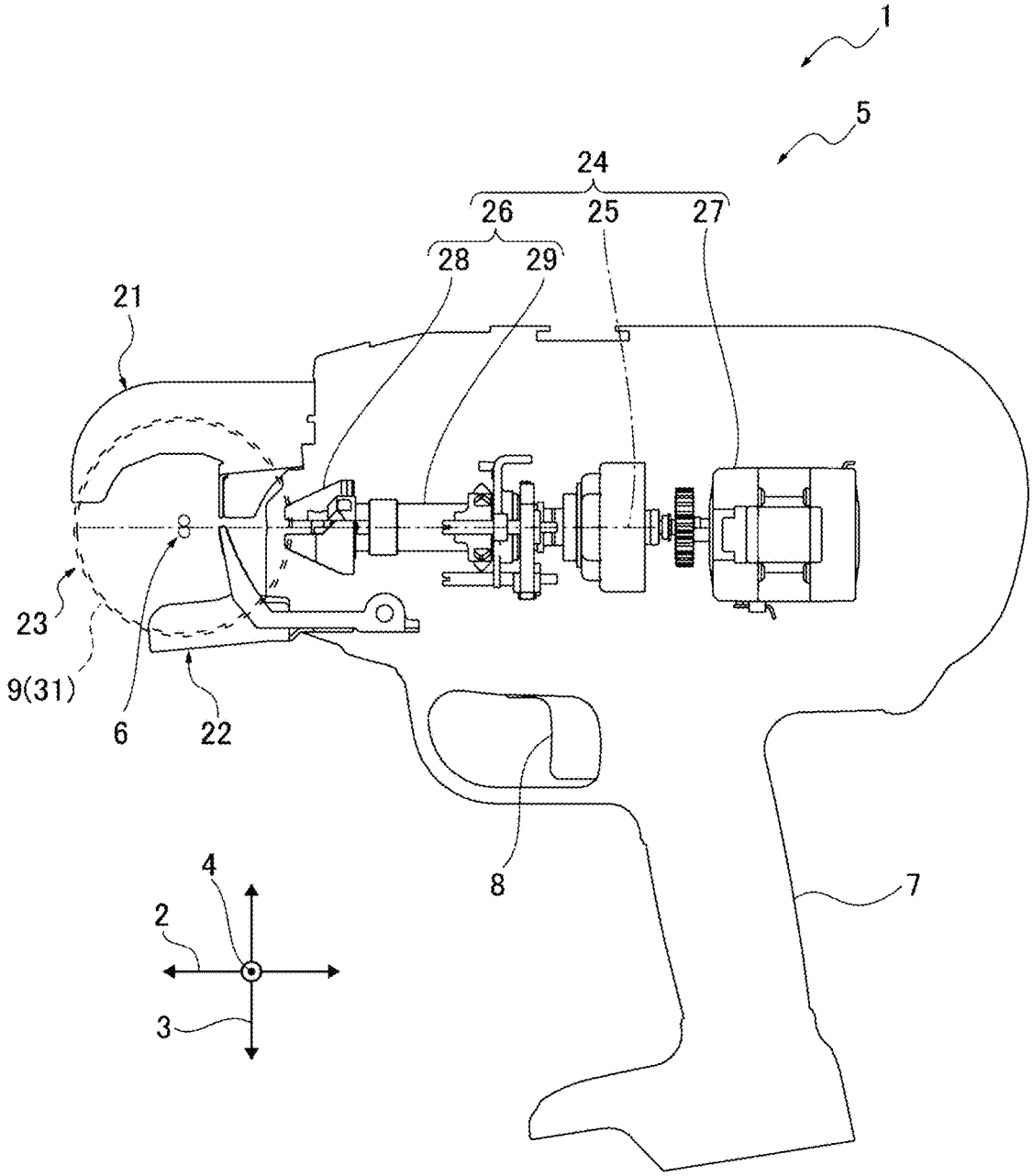
FIG. 2 is a left side view of the binding machine of FIG. 1.

As shown in FIG. 2, the binding machine main body 5 is provided with a twisting part 24 configured to perform the binding by twisting the wire 9 wound in the loop shape around the binding target 6 to reduce a diameter of the loop. The twisting part 24 includes a twisting mechanism 26 having a shaft 25 extending in the front and back direction 2, and an electric motor 27 (twisting motor) configured to rotatively drive the shaft 25 of the twisting mechanism 26.

The twisting mechanism 26 includes a pair of hook parts 28 provided at a tip end-side of the shaft 25 and configured to grip and open a portion of the wire 9 of the loop shape, and a sleeve 29 to be screwed to a screw part provided on an outer periphery of the shaft 25. When the shaft 25 is rotated by the electric motor 27, the sleeve 29 is moved forward or backward or rotated with respect to the shaft 25, so that the hook parts 28 are enabled to perform gripping/opening movement, movement in forward or backward direction or rotational movement.

The diverse driving devices such as the electric motor 16, the electric motor 27 and the like mounted to the binding machine 1 are sequentially controlled by a control circuit.

Figure 3:
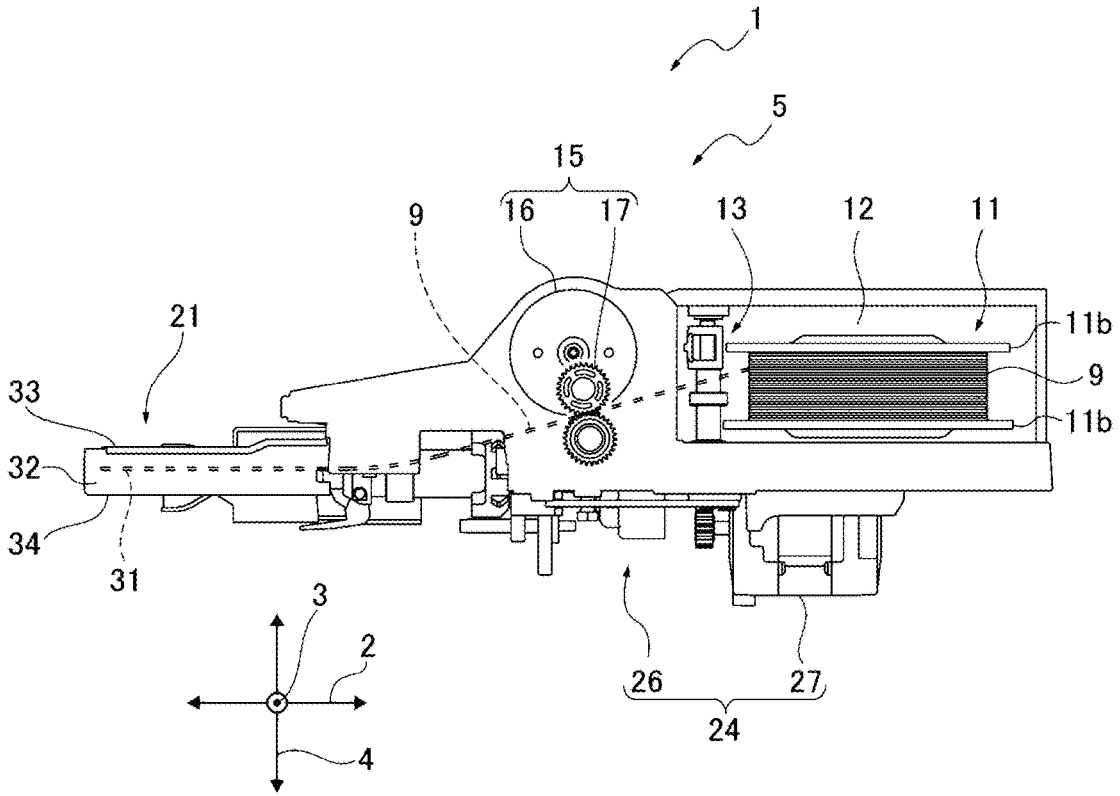
FIG. 3 is a plan view of the binding machine of FIG. 2.

As shown in FIG. 3, at least the upper curl guide 21 of the upper and lower curl guides 21, 22 has a substantially C-shaped or U-shaped section opening downward and having an outer periphery-side surface 32 (outer periphery wall part) having a shape substantially conforming to a locus 31 (refer to FIG. 2) for circulating the wire 9 in the loop shape and a pair of right and left side surfaces 33, 34 (sidewall parts) erected from both sides of the outer periphery-side surface 32 toward an inner side of the locus 31. The outer periphery-side surface 32 is configured to guide the wire 9 in the loop shape, and the pair of right and left side surfaces 33, 34 is configured to guide and keep the wire 9 circulating in the loop shape from sides.

Like the upper curl guide 21, the lower curl guide 22 may have a substantially C-shaped or U-shaped section opening upward and having an outer periphery-side surface (outer periphery wall part), and a pair of right and left side surfaces (sidewall parts) erected from both sides of the outer periphery-side surface.

Figure 4:
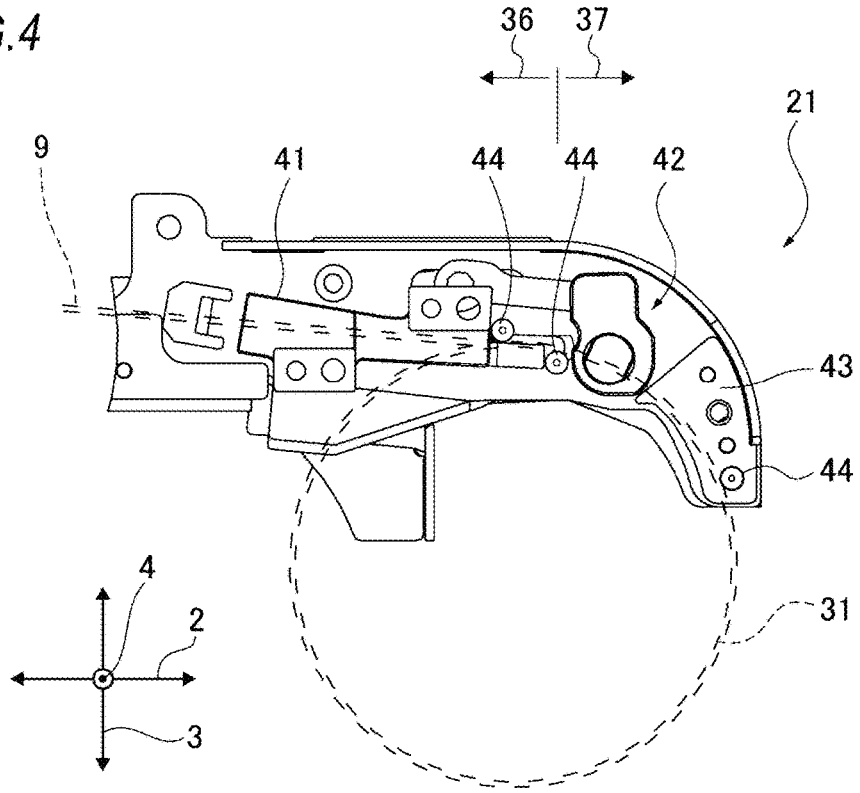
FIG. 4 is a side view depicting an internal structure of an upper curl guide of FIG. 1.

As shown in FIG. 4, the upper curl guide 21 has a linear part 36 extending in the front and back direction 2 and a curved part 37 provided at a tip end-side of the linear part 36, as seen from a side (the width direction 4). The curved part 37 has a circular arc shape substantially conforming to the locus 31 for circulating the wire 9 in the loop shape, for example.

In the upper curl guide 21, a guide member 41 configured to guide forward the wire 9 extends up to a front side of the curved part 37, and a cutting part (a cutter mechanism) 42 configured to cut the wire 9 to a necessary length is provided in front of the guide member 41. In the curved part 37, a curl plate 43 configured to reform and curl the wire 9 is provided in front of the cutting part 42. In addition, the upper curl guide 21 is provided therein with a wire guide member 44 for guiding the wire 9 along the locus 31 for circulating the same in the loop shape, and the like. The wire guide member 44 is configured as a member for wear prevention, such as a carbide pin, a ceramic pin or the like extending in the width direction 4. The wire guide member 44 is provided in a singular or plural number.

Figure 5:
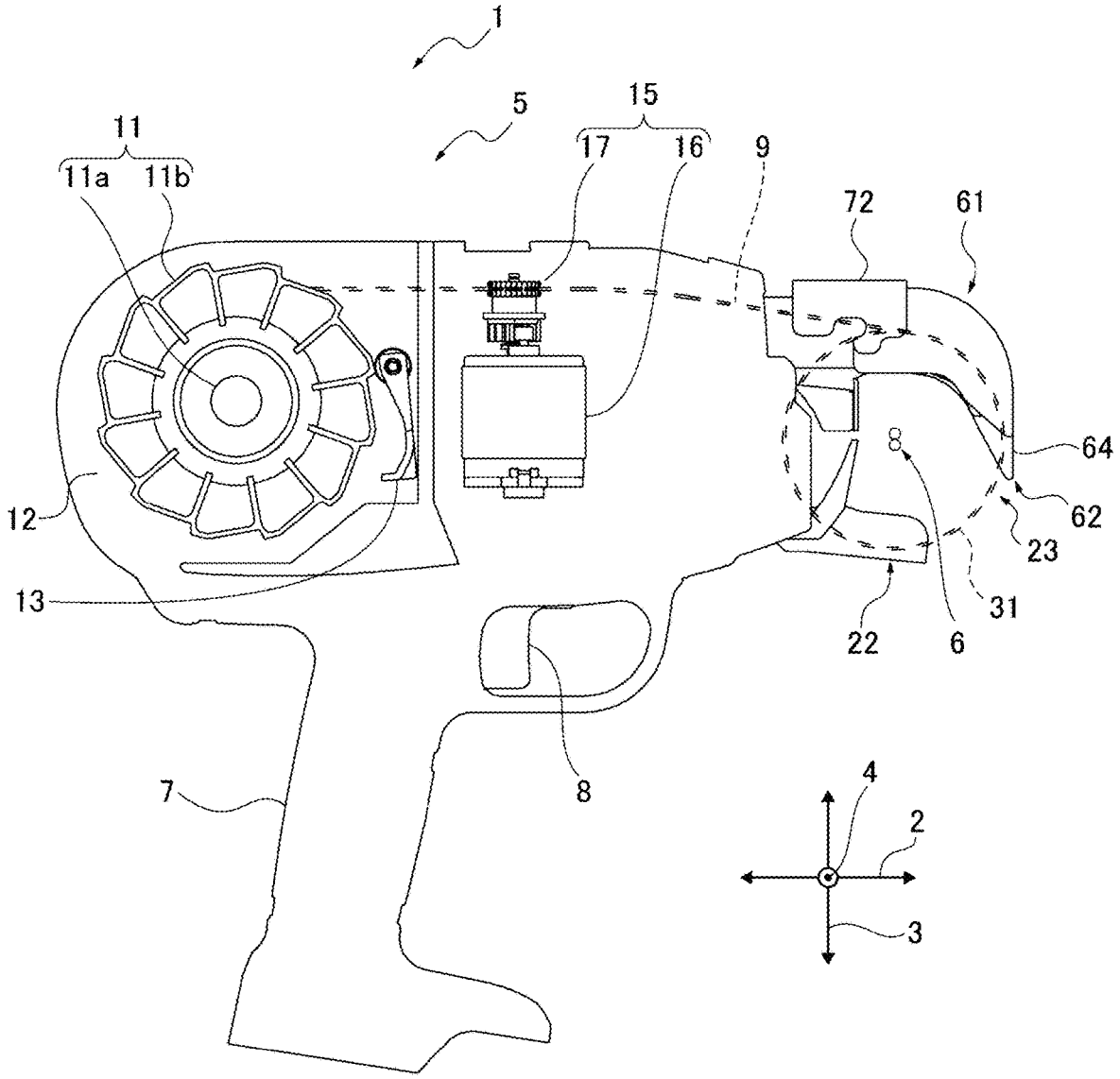
FIG. 5 is a right side view of the binding machine having the auxiliary member for binding machine of the embodiment mounted thereto.
Figure 6:
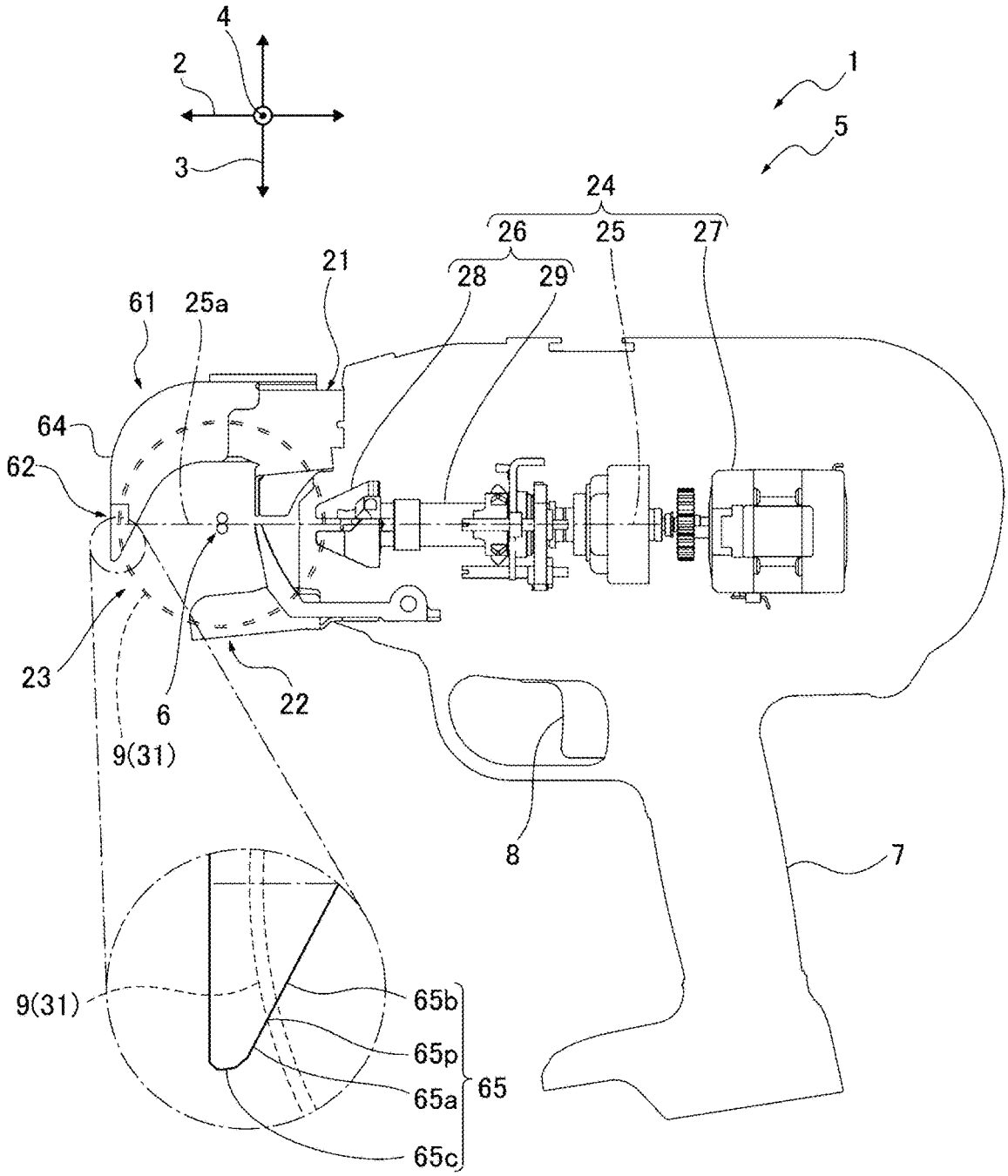
FIG. 6 is a left side view of the binding machine of FIG. 5.
Figure 7:
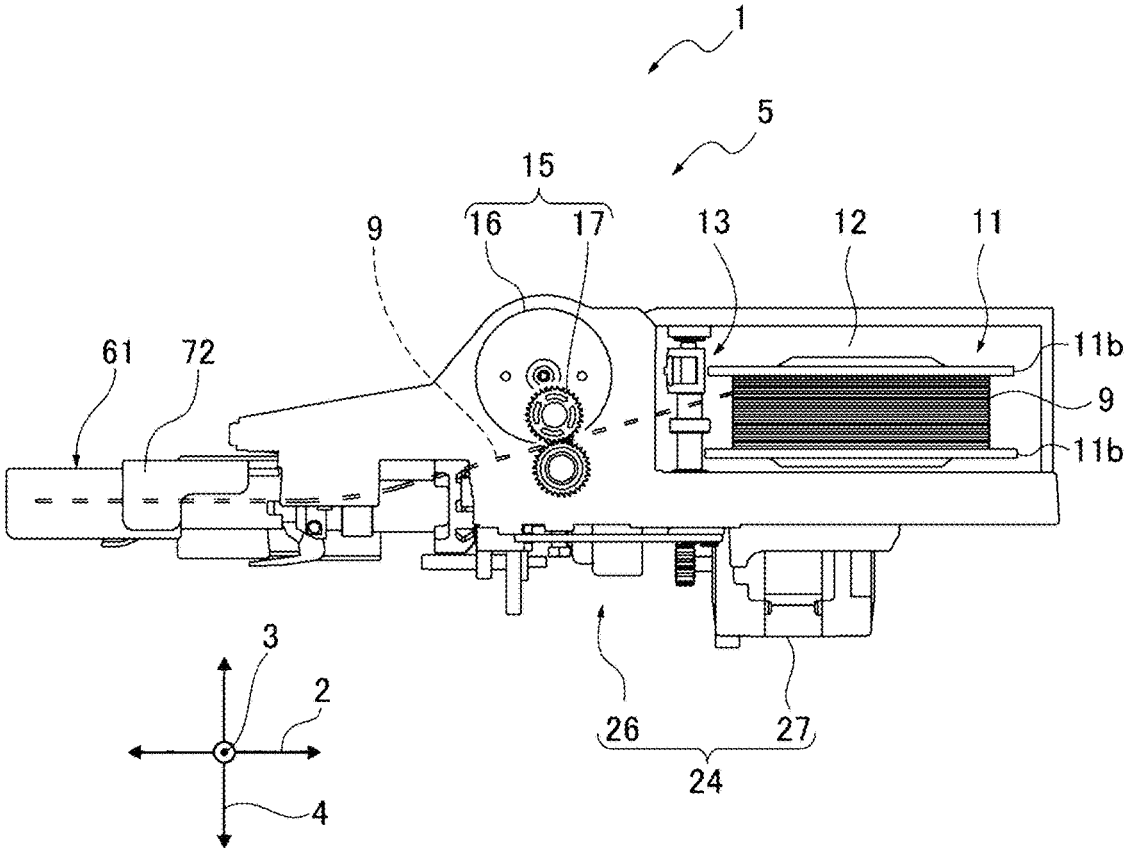
FIG. 7 is a plan view of the binding machine of FIG. 5.
Figure 8:
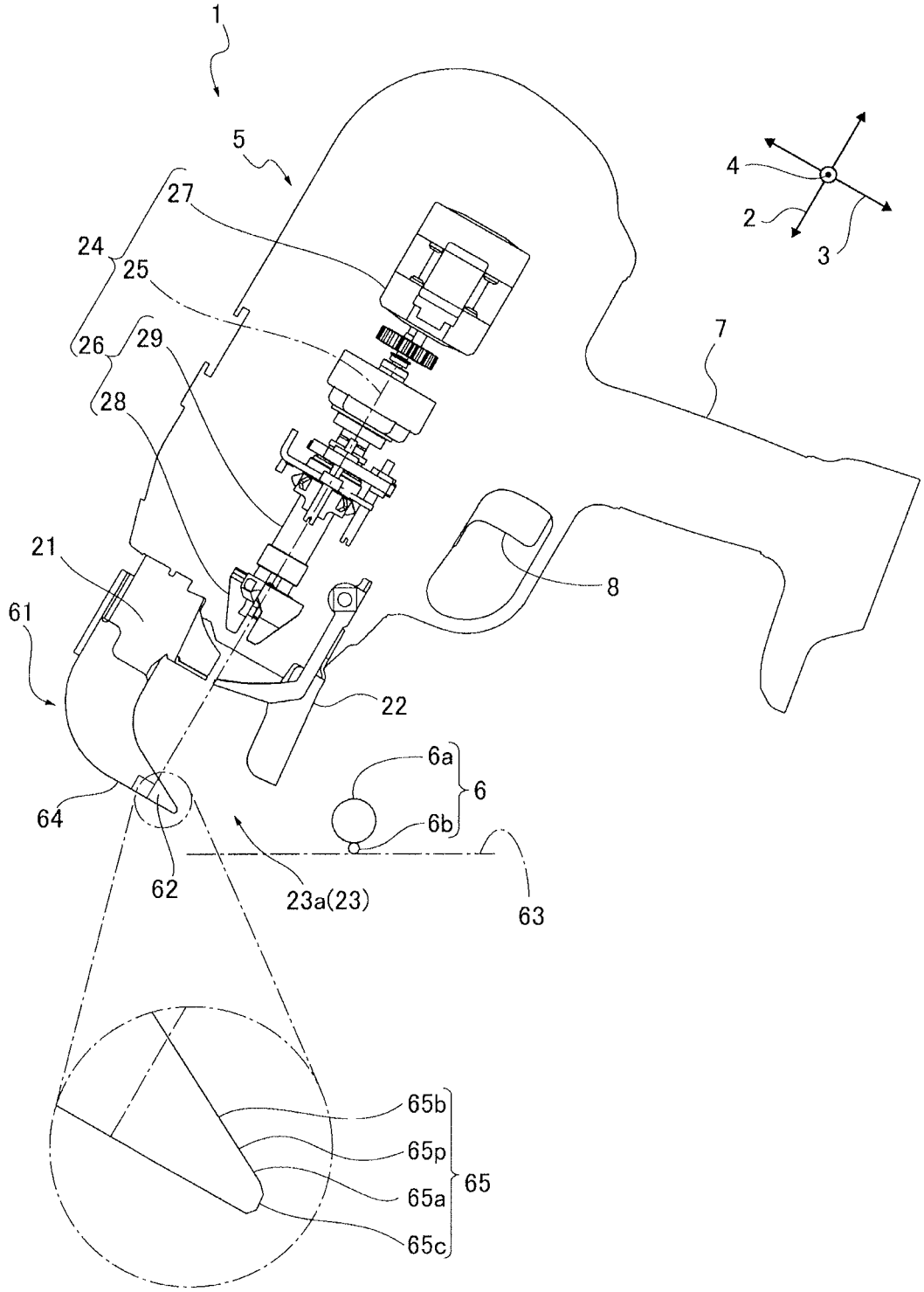
FIG. 8 depicts a using aspect of the binding machine of FIG. 6 (before scooping up the same).
Figure 9:
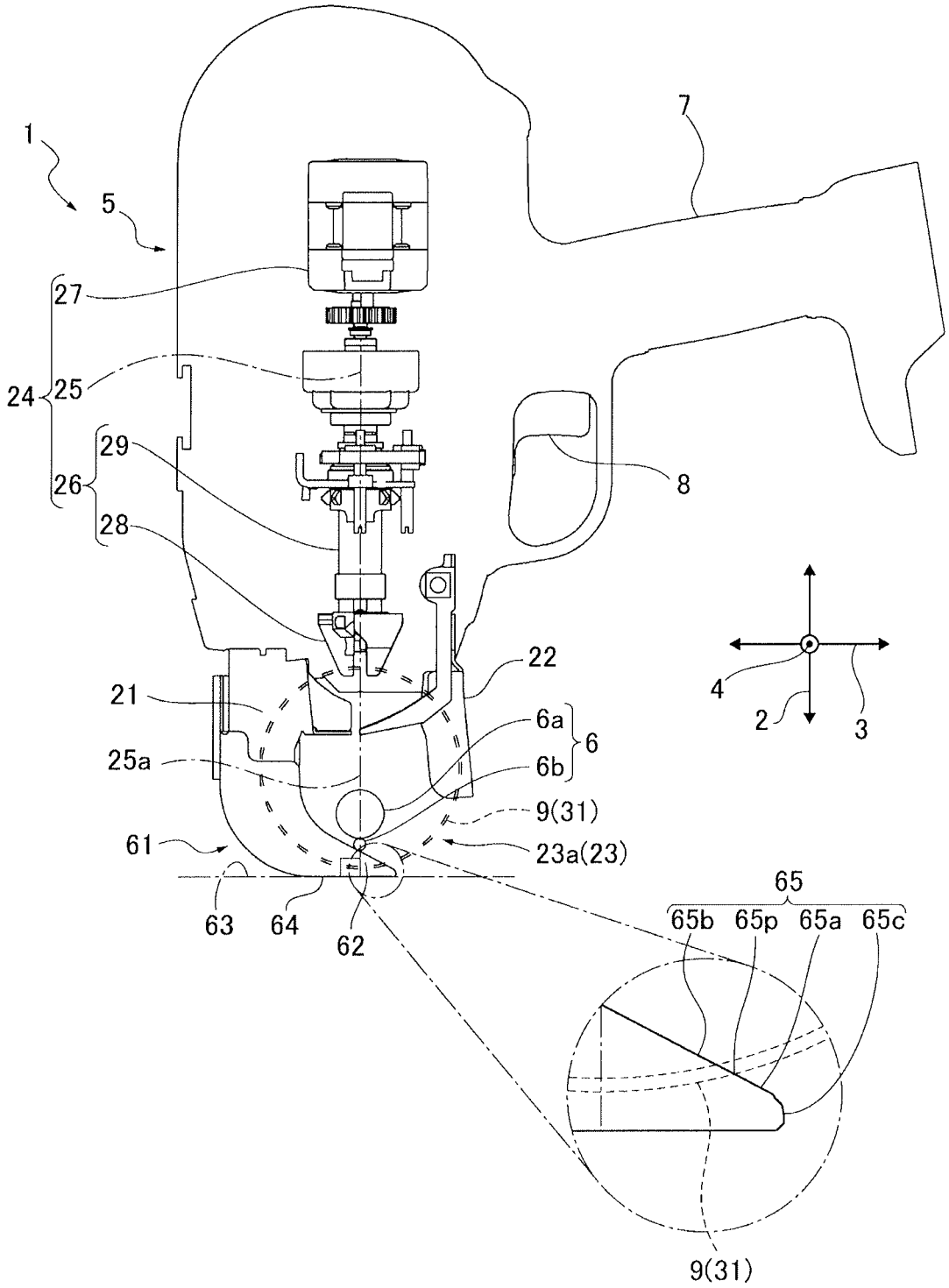
FIG. 9 depicts a using aspect of the binding machine subsequent to FIG. 8 (after scooping up the same).
Figure 10A:
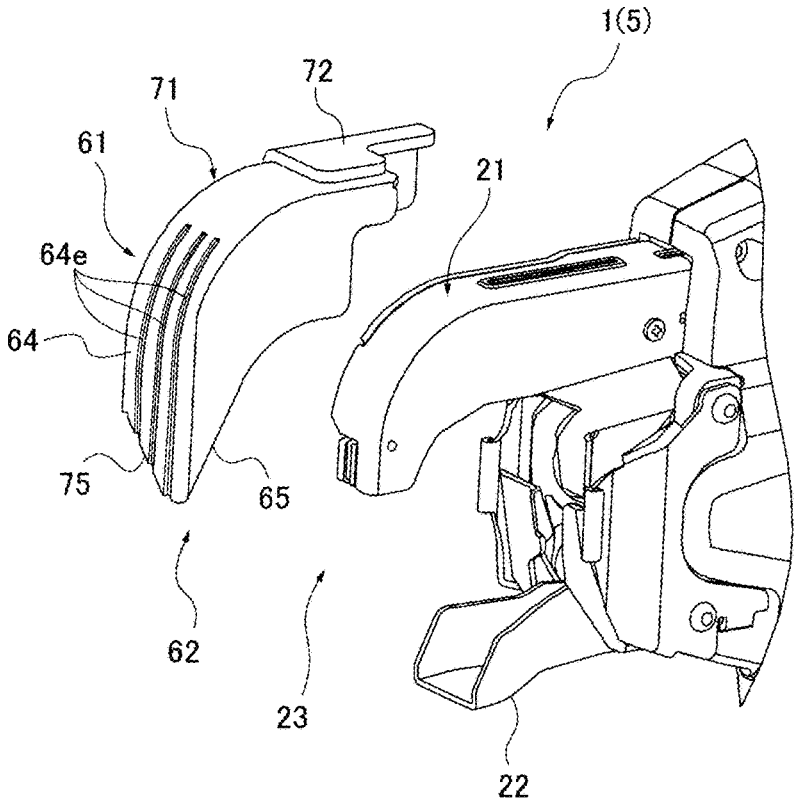
FIG. 10A is a perspective view of the auxiliary member for binding machine before it is mounted to the upper curl guide, as seen from a left oblique upper side.
Figure 10B:
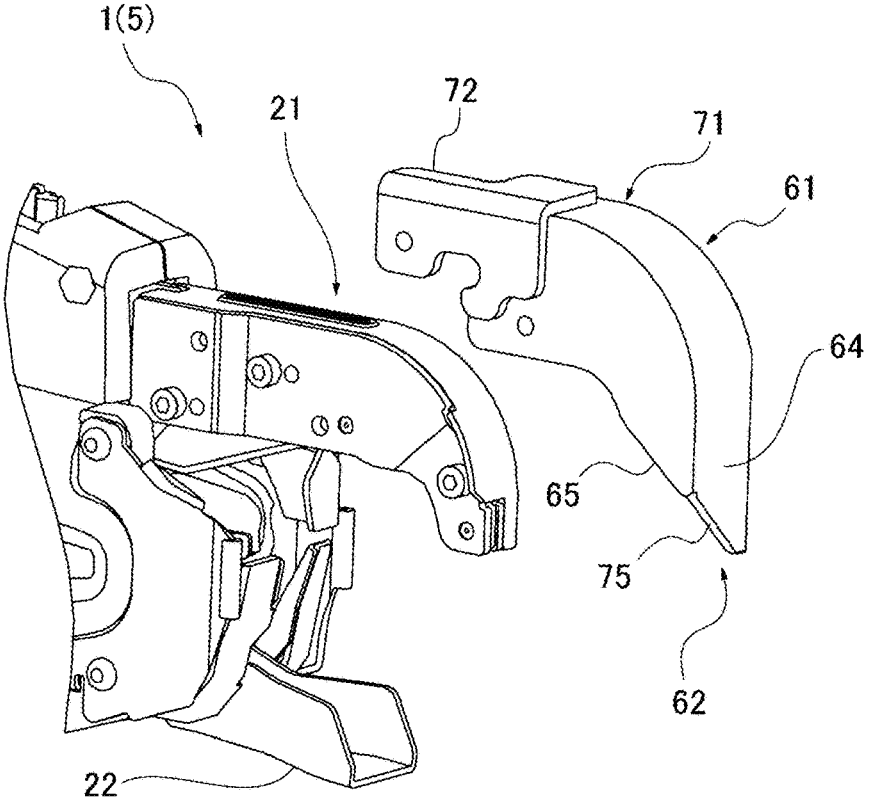
FIG. 10B is a perspective view of the auxiliary member for binding machine before it is mounted to the upper curl guide, as seen from a right oblique upper side.

In the embodiment, an auxiliary member 61 for binding machine (for example, FIGS. 10A and 10B) is provided to the binding machine 1, as shown in FIGS. 5 to 7, and can be used as shown in FIGS. 8 and 9. In the below, the binding machine 1 having the auxiliary member 61 for binding machine is described.

(1) As shown in FIG. 9 (or FIG. 6) and the like, the binding machine 1 includes the curl guides 21, 22 configured to guide the wire 9 in the loop shape around the binding target 6, and the twisting part 24 configured to bind the binding target 6 by twisting the wire 9 guided in the loop shape around the binding target 6. The curl guides 21, 22 have a tapered protrusion 62 at a tip end-side.

Herein, the auxiliary member 61 for binding machine is a member (attachment) that is to be used for the binding machine 1 in an auxiliary manner and can add a new function to the binding machine 1. The auxiliary member 61 for binding machine is made of metal or the like. In this case, the auxiliary member 61 for binding machine is configured as a scoop-up member capable of scooping up (or lifting) the binding target 6, which is arranged to be in contact with a contact surface 63, without using a hand.

In the drawings, the auxiliary member 61 for binding machine is mounted to the upper curl guide 21. In the below, the configuration where the auxiliary member 61 is mounted to the upper curl guide 21 is mainly described. However, as described later, the auxiliary member 61 for binding machine may be mounted to the lower curl guide 22. Meanwhile, in the drawings, the auxiliary member 61 for binding machine is configured as a member different from the binding machine 1. However, a structure and a function of the auxiliary member 61 for binding machine may be integrally incorporated to the binding machine 1, depending on situations.

The protrusion 62 is a part that protrudes beyond the tip end portions of the curl guides 21, 22 when using the auxiliary member 61 for binding machine.

The tapered shape is a pointed shape such as a claw shape, a beak shape and the like. The tapered shape may be any shape inasmuch as a tip of the protrusion 62 is thinned. For example, the tapered shape may include a variety of states such as a state where the tip of the protrusion 62 is thinned as seen in the front and back direction 2, a state where the tip is thinned as seen in the height direction 3, a state where the tip is thinned as seen in the width direction 4, a state where a thickness of the protrusion 62 gradually decreases and the tip is thus thinned, and the like.

The binding target 6 may be a rod-shaped member such as a reinforcing bar, for example. When constructing a floor heating, the binding target 6 is configured of a pipe member 6*a* such as a pipe for heating or the like and a rod-shaped member 6*b* such as a mesh bar, for example.

(2) The protrusion 62 has a guide part 64 provided on an outer periphery-side thereof and arranged substantially perpendicularly to an extension line 25*a* of the shaft 25 of the twisting part 24.

Herein, the guide part 64 is preferably configured to be moveable along the contact surface 63 with which the binding target 6 is arranged to be in substantial contact (the moveable guide part). The contact surface 63 may be any surface inasmuch as it is a surface on which the binding target 6 is arranged to be in substantial contact. The contact surface 63 may be a horizontal surface such as a floor, a vertical surface such as a wall, and the other surfaces (an inclined surface and the like), for example. When constructing a floor heating, the contact surface 63 is a horizontal surface (floor surface) such as a concrete floor. The pipe for heating and the mesh bar are directly placed with being vertically superimposed on the concrete floor. However, the binding target 6 may be arranged with being slightly floated from the contact surface 63. In this case, the contact surface 63 is a placement surface on which the binding target 6 is arranged. In the below, it is assumed that the contact surface 63 includes the placement surface of the binding target 6.

In other words, the curl guides 21, 22 have the tapered protrusion 62 formed to be thinned toward the tip end-side, as seen in a first direction (width direction 4) perpendicular to the extension line 25*a* of the shaft 25 of the twisting part 24, and the protrusion 62 has the guide part 64 configuring an outer surface, as seen in the first direction (width direction 4). The guide part 64 is configured as a surface perpendicular to the extension line 25*a* and substantially conforming to a second direction (height direction 3) perpendicular to the first direction (width direction 4). In this case, the first direction is the width direction 4 but is not limited thereto.

The description "substantially perpendicular" indicates that the guide part 64 and the extension line 25*a* of the shaft 25 are substantially perpendicular to each other but an error of about ±8° is allowed. However, preferably, about ±5°, and more preferably, about ±3° is set. The guide part 64 is preferably set to a length or longer within which it actually intersects with the extension line 25*a* of the shaft 25.

Figure 11:
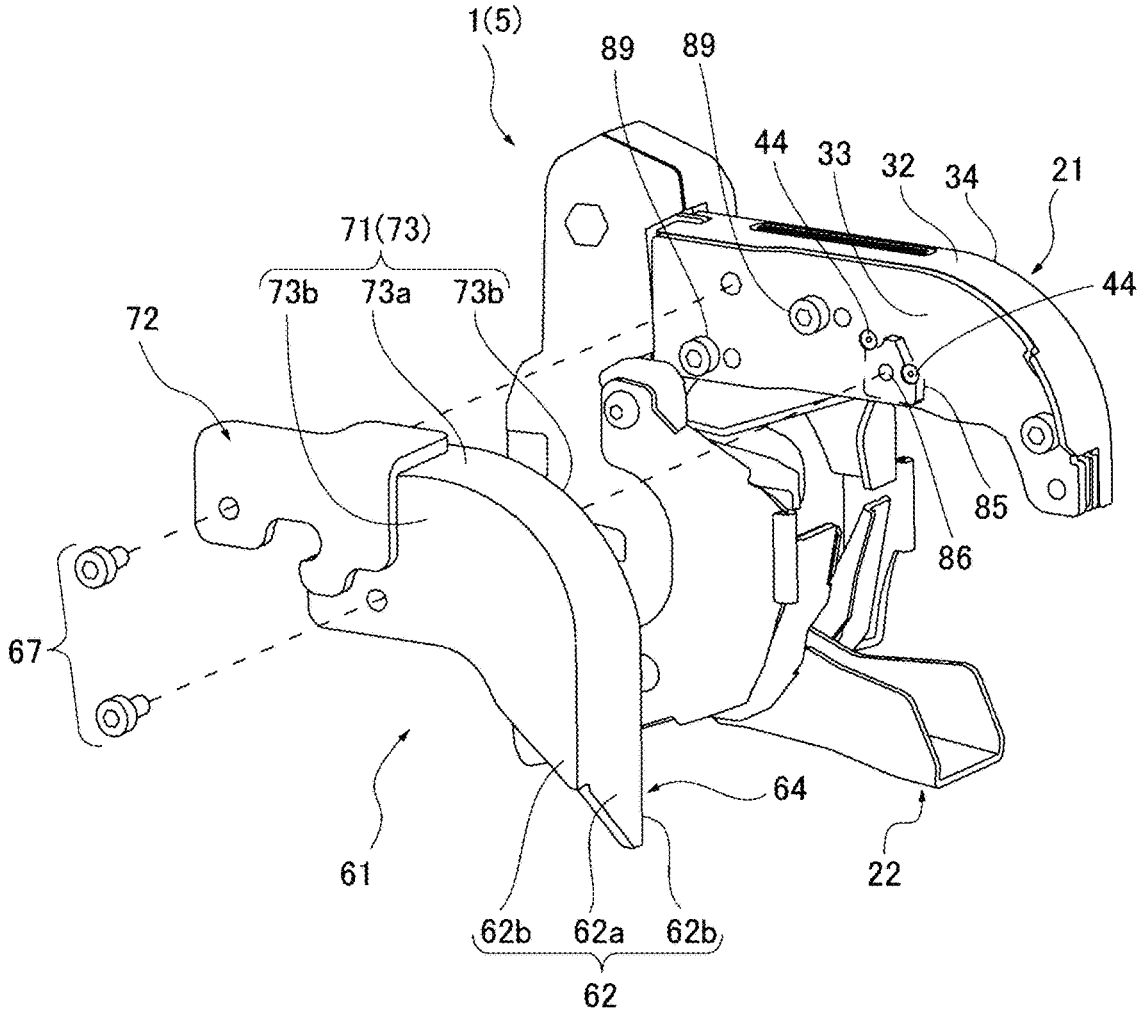
FIG. 11 is a perspective view depicting an aspect of mounting and demounting a protrusion to and from the upper curl guide.

(3) As shown in FIG. 11, the protrusion 62 may be configured to be detachably mounted to the curl guides 21, 22 or the binding machine main body 5 configured to support the curl guides 21, 22 (the detachable protrusion).

Herein, according to the binding machine of the related art, when binding a binding target put on a ground, for example, the curl guide may collide with the ground and may be thus damaged. In this case, the binding machine should be disassembled to replace the curl guide, which takes labor. Therefore, in order to prevent the damage of the curl guides 21, 22, the detachable protrusion 62 configured to be mounted and demounted to and from the binding machine 1 is provided. The mounting and demounting of the protrusion 62 to and from the curl guides 21, 22 or the binding machine 1 can be performed using a dedicated fixing tool 67 or the like. The dedicated fixing tool 67 may be a screw or the like. The dedicated fixing tool 67 (a screw or the like) may be provided in a singular or plural number. In the drawings, the dedicated fixing tool 67 is configured as two screws extending in the width direction 4.

In contrast, when the protrusion 62 is directly fixed to the curl guides 21, 22 or the binding machine 1 by welding or adhesion, it cannot be detachable.

As described above, the guide part 64 is a part becoming a guide of the binding machine 1. The guide part 64 is a guide part that enables the protrusion 62 to smoothly move with the binding machine 1 by moving the guide part in a longitudinal direction with keeping a contact state of two or more points with the contact surface 63. Specifically, the guide part may be configured as follows.

Figure 24A:
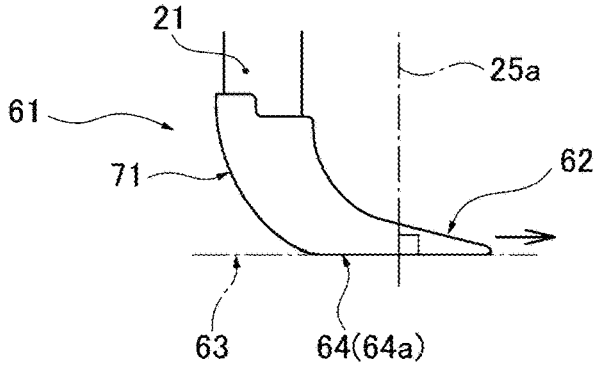
FIG. 24A is a partially enlarged view of FIG. 9, depicting a guide part.

(4) The guide part 64 is preferably configured as a planar surface. For example, as shown in FIG. 24A, the guide part 64 may be configured by a linear guide part (or a planar guide part) 64*a*, which is substantially linear, as seen from a side.

Figure 24B:
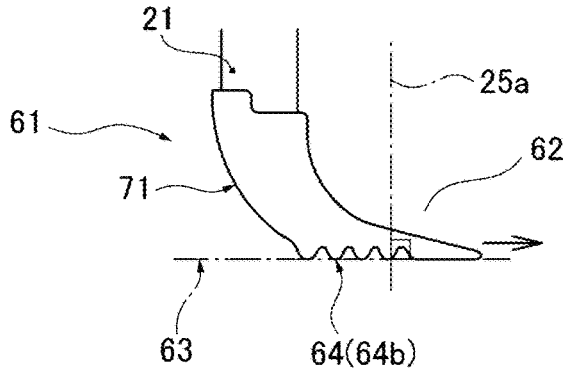
FIG. 24B is a partially enlarged view of FIG. 9, depicting another example of the guide part.

(5) The guide part 64 may be configured as a planar surface having a convex portion or a concave portion. For example, the guide part 64 may be configured by a concavo-convex guide part 64*b* having a concavo-convex portion shown in FIG. 24B, as seen from a side, a two-point-like guide part 64*c* having two projections shown in FIG. 24C, as seen from a side, or the like provided for the linear guide part (or a planar guide part) 64*a* shown in FIG. 24A. The convex portions of the guide part 64 are preferably configured so that apexes are linearly aligned side by side, as seen from a side. A direction of the convex portions may be the width direction 4 of the binding machine main body 5, as shown in FIG. 24B, or the front and back direction 2, the extension direction (protrusion direction) of the protrusion 62 or the like, like a plurality of concave recesses 64*e* shown in FIG. 10A. In this way, the guide part 64 is configured by the concavo-convex guide part 64*b*, the two-point-like guide part 64*c*, the concave recesses 64*e* or the like, so that it is possible to reduce a frictional resistance by reducing a contact area with the contact surface 63.

Figure 24C:
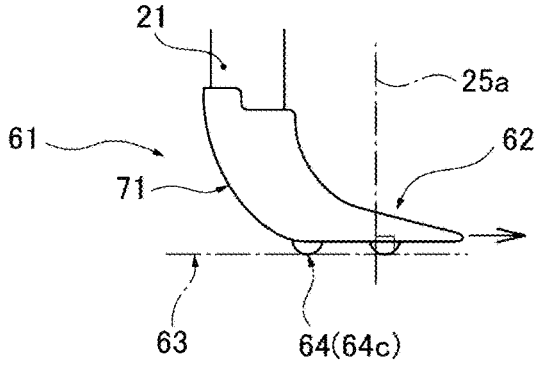
FIG. 24C is a partially enlarged view of FIG. 9, depicting another example of the guide part.
Figure 24D:
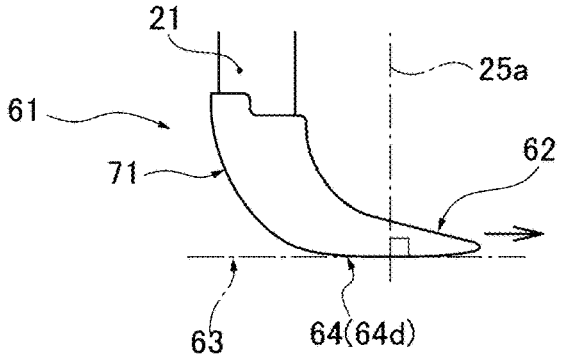
FIG. 24D is a partially enlarged view of FIG. 9, depicting another example of the guide part.

(6) The guide part 64 may be configured as a curved surface approximate to a planar surface. For example, as shown in FIG. 24D, the guide part 64 may be configured by a gently curved guide part 64*d*, which has a large radius of curvature and is similar to the linear guide part 64*a* shown in FIG. 24A.

The guide part 64 may be provided within a range greater than the tip end portion of the outer periphery-side of the protrusion 62. In the meantime, for example, a part that has a linear part at the outer periphery-side but cannot be used as the guide part is excluded from the guide part 64.

In this case, a protrusion length of the protrusion 62 having the guide part 64 at the tip end portion of the outer periphery-side is a distance from a position of the tip end portion of the curl guides 21, 22 to the tip end portion (of the guide part 64) beyond a position intersecting with the extension line 25*a*. The protrusion 62 is preferably set to have a length within which it is possible to sufficiently secure an opening 23*a* for inserting the binding target 6 between the protrusion and the tip end of the opposite one of the curl guides 21, 22. In the meantime, the opening 23 between the tip end portions of the curl guides 21, 22 becomes an opening 23*a* narrower than the opening 23 as the auxiliary member 61 for binding machine is mounted.

(7) The protrusion 62 may be configured to have a pointed tip end and may be provided at an inner periphery-side opposite to the guide part 64 with an inclined guide part 65 for guiding the binding target 6 from a tip end-side toward a base end-side.

Herein, the description "pointed tip end" indicates a side surface shape of the protrusion 62 configured by the guide part 64 and the guide part 65 when the binding machine 1 is seen from a side (the width direction 4). The guide part 65 may be configured to have a continuous constant inclination shape from a tip end-side toward a base end-side so as to smoothly pass between an inside and an outside of the loop-shaped locus 31 of the wire 9, for example. In the embodiment, the guide part 65 is set as an inclination part inclined relative to the guide part 64 by about 15° to 30° and having a substantially linear shape or a curved shape close to a straight line.

(7-1) The guide part 65 is configured to have a boundary part 65*p* at a position beyond the extension line 25*a* of the shaft 25 of the twisting part 24. The boundary part 65*p* guides the binding target 6 from the outside toward the inside of the locus 31 of the wire 5.

That is, the guide part 65 has a shape having a part 65*a* positioned outside the loop-shaped locus 31 of the wire 9 at the tip end-side of the continuous constant inclination shape part and a part 65*b* positioned inside the loop-shaped locus 31 of the wire 9 at the base end-side (a side facing toward the binding machine main body 5) and passing between the inside and the outside of the loop-shaped locus 31 of the wire 9.

A side of the guide part 65 closer to the tip-end side than the boundary part 65*p* becomes the part 65*a* positioned outside the locus 31 of the wire 9, and a side (a side facing toward the binding machine main body 5) of the guide part 65 closer to the base end-side than the boundary part 65*p* becomes the part 65*b* positioned inside the locus 31 of the wire 9.

A tip end portion 65*c* (of the continuous constant inclination shape part) of the guide part 65, which is positioned at the tip end of the tapered protrusion 62, may be configured as a corner portion intersecting with the guide part 64 at an acute angle, a round portion obtained by rounding the corner portion, a step portion obtained by notching the corner portion or the like. However, (particularly, when the tip end portion is configured as a step portion or the like), a distance (step amount) between the tip end portion 65*c* of the guide part 65 and the guide part 64 in the front and back direction 2 of the binding machine main body 5 is preferably set to a height (for example, a height equal to or smaller than about a radius of the binding target 6: 8 mm or the like) within a range in which the tip end portion 65*c* of the guide part 65 can be inserted at least between the binding target 6 and the contact surface 63 without difficulty and there occurs no problem, which is caused as the tip end portion 65*c* of the guide part 65 collides with the binding target 6. The tip end portion 65*c* of the guide part 65 is set to the above height, so that it is possible to smoothly guide the binding target to the continuous constant inclination shape part of the guide part 65.

In this case, since the protrusion 62 is preferably configured to insert the tip end thereof between the binding target 6 and the contact surface 63, (a length in the extension direction of the protrusion 62 of) the part 65*a* positioned outside the loop-shaped locus 31 of the wire 9 located at the tip end-side of the guide part 65 is made to be short. However, the part 65*a* positioned outside the loop-shaped locus 31 of the wire 9 located at the tip end-side may be made to be long by lengthening the guide part 64. In the meantime, structurally, the boundary part 65*p* of the guide part 65 may be set at a position not exceeding the extension line 25*a*.

As shown in each embodiment of FIGS. 12A to 15B (mainly, refer to FIGS. 12A and 12B), the protrusion 62 may be mounted to be displaceable relative to the curl guides 21, 22 (a replaceable protrusion).

The description "displaceable" indicates that the protrusion 62 can be mounted with a position thereof being changed relative to the curl guides 21, 22. Alternatively, the description "displaceable" indicates that a position of the protrusion 62 can be changed with being mounted to the curl guides 21, 22.

Figure 12A:
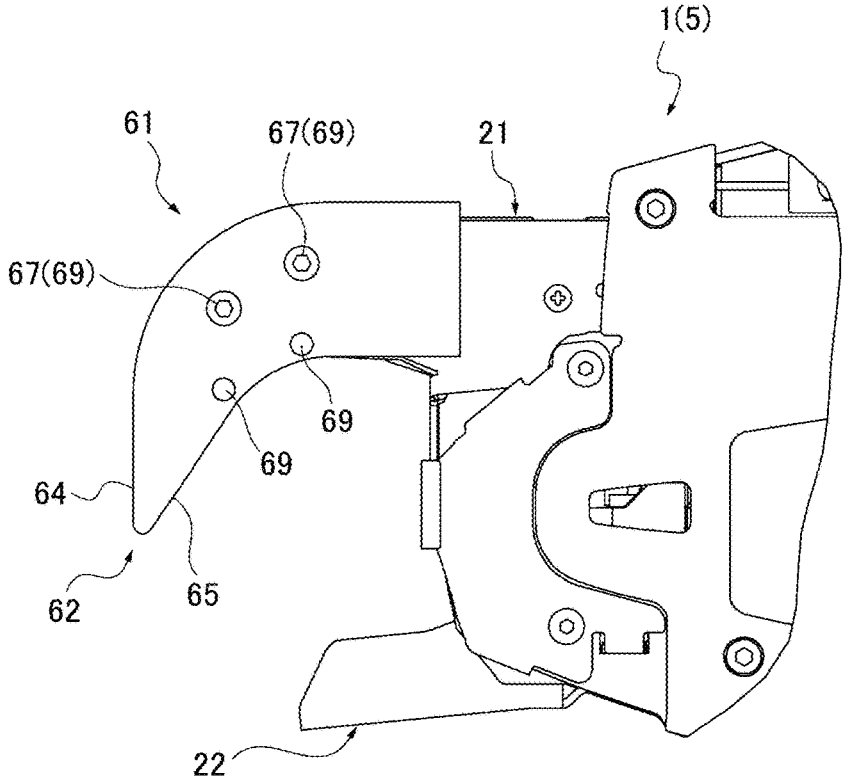
FIG. 12A is a side view of an embodiment of the auxiliary member for binding machine configured to be moveable relative to the upper curl guide, depicting a state before movement (an aspect where the auxiliary member for binding machine is used).
Figure 12B:
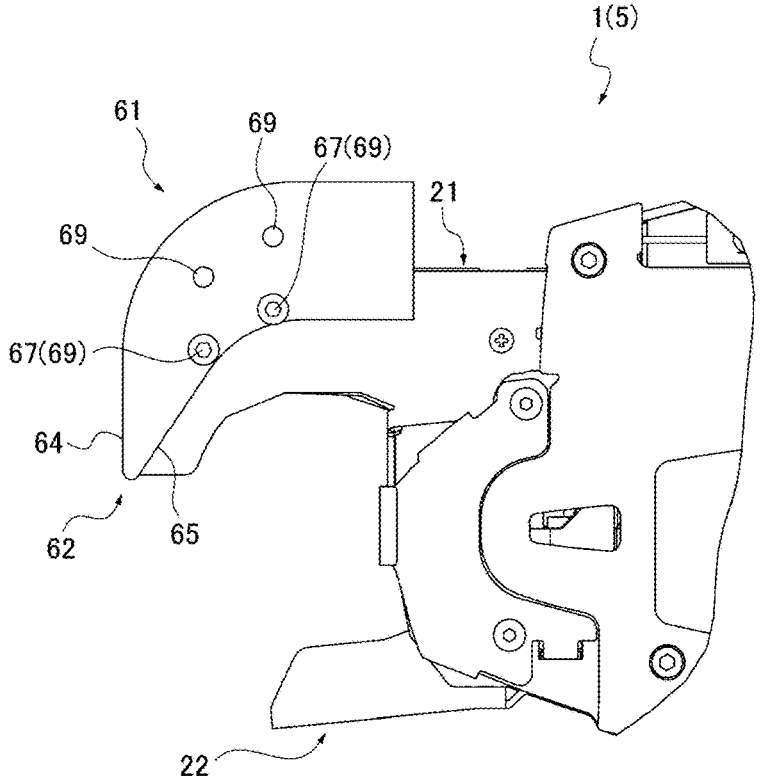
FIG. 12B is a side view depicting a state after movement of the auxiliary member for binding machine of FIG. 12A (an aspect where auxiliary member for binding machine is not used).

The position change can be implemented by additionally forming the protrusion 62 with screw holes 69 of which the number is greater than the number of the dedicated fixing tools 67 and configuring any one of the screw holes 69 to be selectively useable for fixing, as shown in FIGS. 12A and 12B (or FIGS. 13A and 13B), for example. Meanwhile, in the embodiment of FIGS. 12A and 12B, the protrusion 62 is configured so that it can be displaced in the substantially vertical direction. Also, in the embodiment of FIGS. 13A and 13B, the protrusion 62 is configured so that it can be displaced in the substantially front and back direction.

Figure 14A:
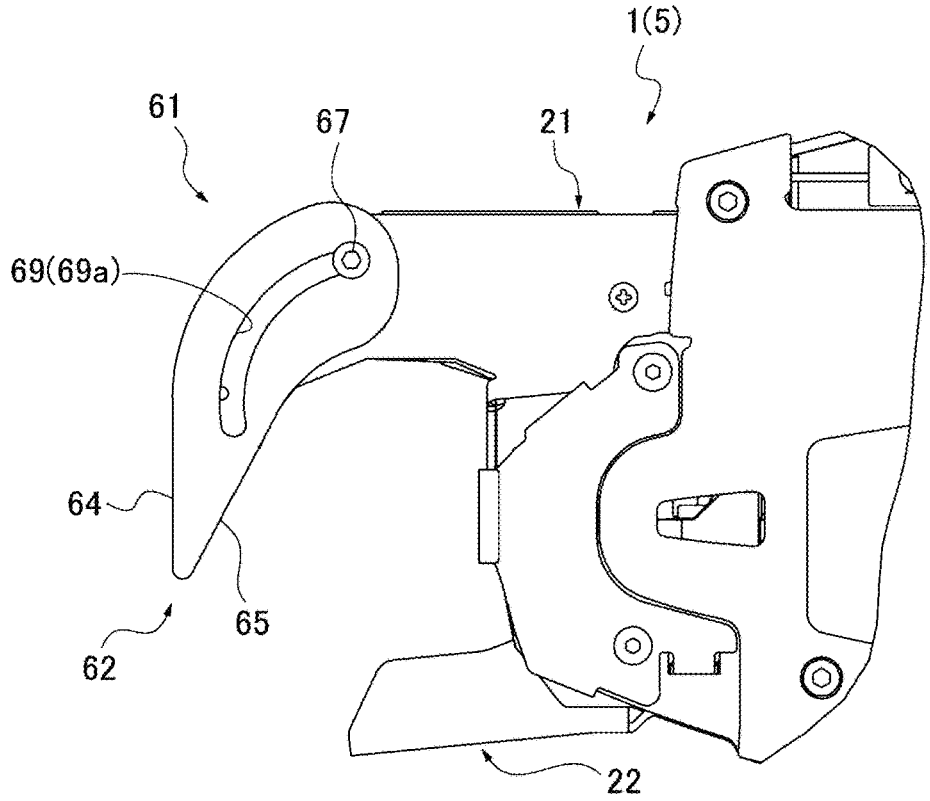
FIG. 14A is a side view of an embodiment of the auxiliary member for binding machine configured to be moveable relative to the upper curl guide by rotation, depicting a state before rotation (an aspect where the auxiliary member for binding machine is used).
Figure 14B:
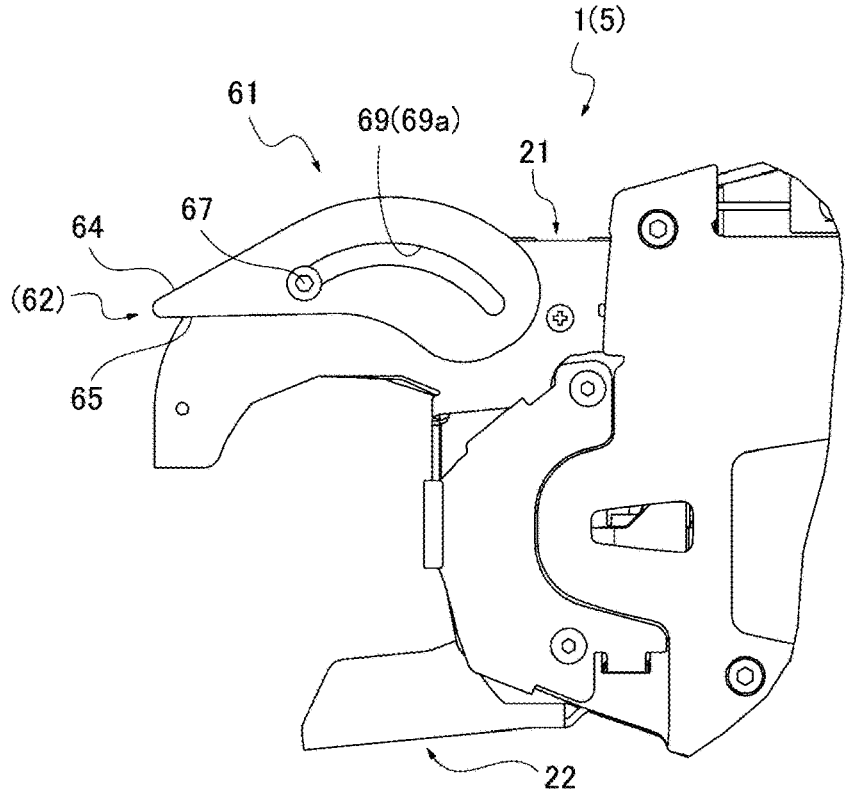
FIG. 14B is a side view depicting a state after rotation of the auxiliary member for binding machine of FIG. 14A (an aspect where the auxiliary member for binding machine is not used).

(8-1) As shown in an embodiment of FIGS. 14A and 14B (or FIGS. 15A and 15B), the protrusion 62 may be mounted to be rotatable relative to the curl guides 21, 22 (a rotatable protrusion).

The description "rotatable" indicates that a position of the protrusion 62 can be changed by moving the same in a circular arc shape or the like with the protrusion 62 being mounted to the curl guides 21, 22. In order to move the protrusion 62 in the circular arc shape, one dedicated fixing tool 67 may be provided, the screw hole 69 of the auxiliary member 61 for binding machine may be formed as a circular arc-shaped long hole 69*a*, and the protrusion 62 may be moved in a circular arc shape along the circular arc-shaped long hole 69*a*, as shown in the embodiment of FIGS. 14A and 14B, for example. In this case, the protrusion 62 is configured so that it can be largely rotatively displaced in the substantially front and back direction.

Figure 15A:
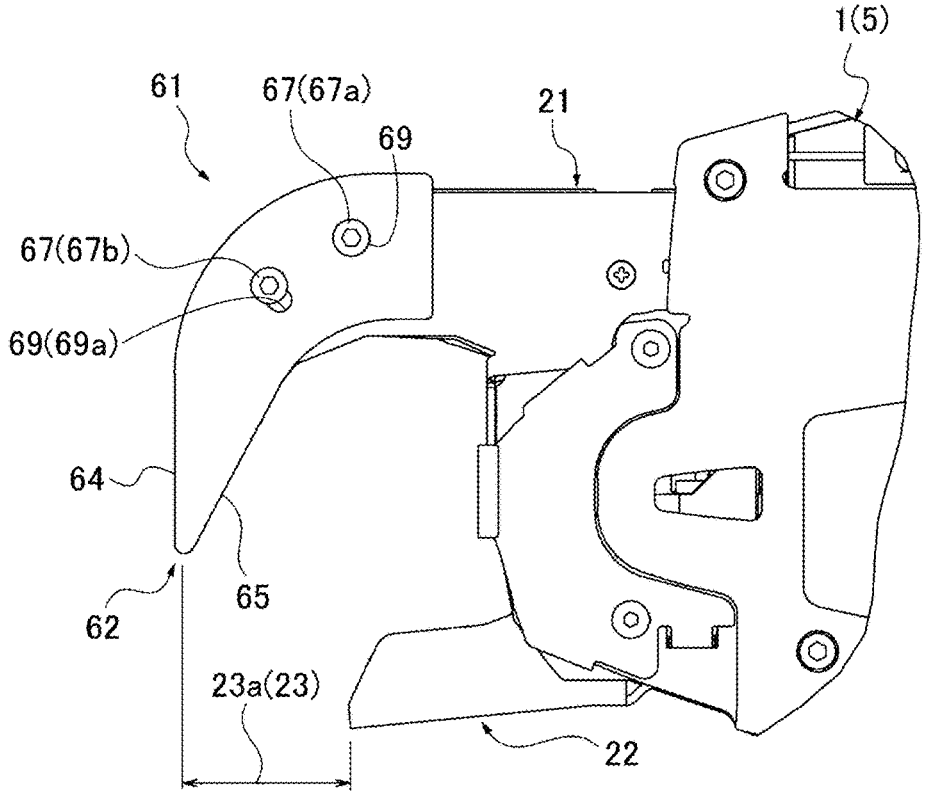
FIG. 15A is a side view of an embodiment of the auxiliary member for binding machine configured to be moveable relative to the upper curl guide by rotation, depicting a state before rotation (before an opening is enlarged).
Figure 15B:
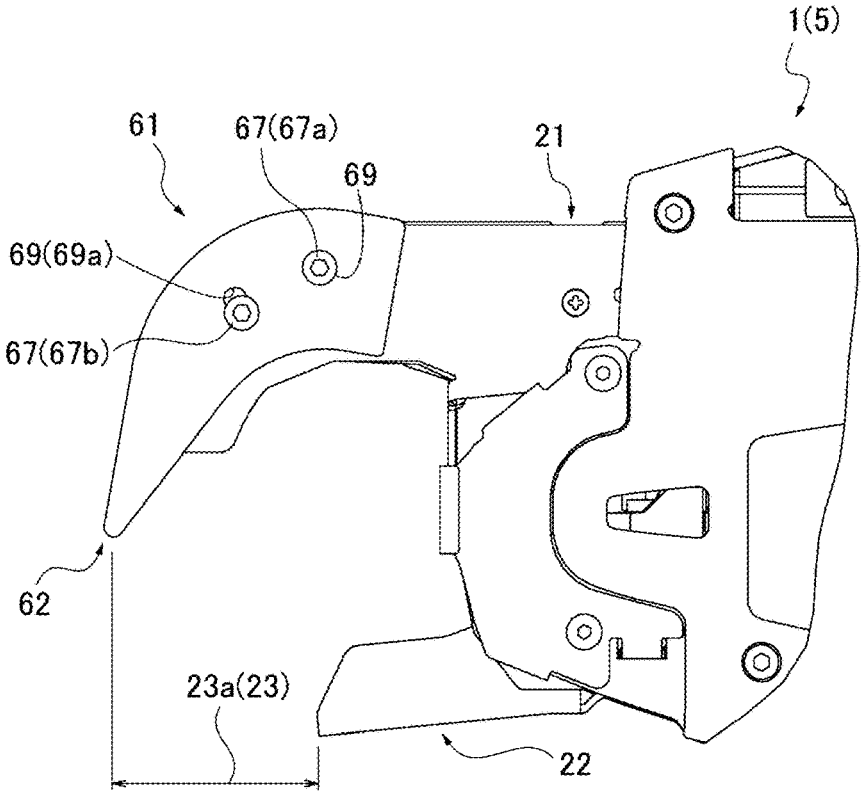
FIG. 15B is a side view depicting a state after rotation of the auxiliary member for binding machine of FIG. 15A (after the opening is enlarged).

Also, as shown in an embodiment of FIGS. 15A and 15B, the two dedicated fixing tools 67 may be provided, one of the dedicated fixing tools may be configured as a rotation shaft 67*a* and the other may be configured as a guide shaft 67*b*, the screw hole 69 of the auxiliary member 61 for binding machine provided at the rotation shaft 67*a*-side may be formed as a circular hole, the screw hole 69 provided at the guide shaft 67*b*-side may be formed as a circular arc-shaped long hole 69*a* of which a center is a position of the rotation shaft 67*a*, and the protrusion 62 may be moved along the circular arc-shaped long hole 69*a*. In this case, the protrusion 62 is configured so that it can be rotatively displaced in the substantially vertical direction.

(8-2) The protrusion 62 may be mounted to be slidable relative to the curl guides 21, 22 (a slidable protrusion).

The description "slidable" indicates that a position of the protrusion 62 can be changed by linearly or curvedly moving (sliding) the same with the protrusion 62 being mounted to the curl guides 21, 22. In order to linearly move the protrusion 62, the protrusion 62 is provided with a linear long hole (slide hole) as the screw hole 69, for example. For instance, in the embodiment of FIGS. 12A and 12B (or FIGS. 13A and 13B), the screw hole may be formed as a long hole (slide hole) connecting the screw holes 69 therebetween before and after the movement.

Also, in order to curvedly slide and move the protrusion 62, the large circular arc-shaped long hole 69*a* may be provided along a movement path, like the embodiment of FIGS. 14A and 14B.

(8-3) As shown in FIG. 1, the curl guides 21, 22 have the opening 23 in which the binding target 6 can be inserted. As shown in the embodiment of FIGS. 13A and 13B (or FIGS. 15A and 15B), the protrusion 62 may be mounted so that a size of the opening 23 can be changed.

Herein, as described above, the opening 23 between the tip end portions of the curl guides 21, 22 becomes the opening 23*a* between the tip end portions of the curl guides 21, 22 and the protrusion 62 by mounting the auxiliary member 61 for binding machine to the curl guides 21, 22.

Figure 13A:
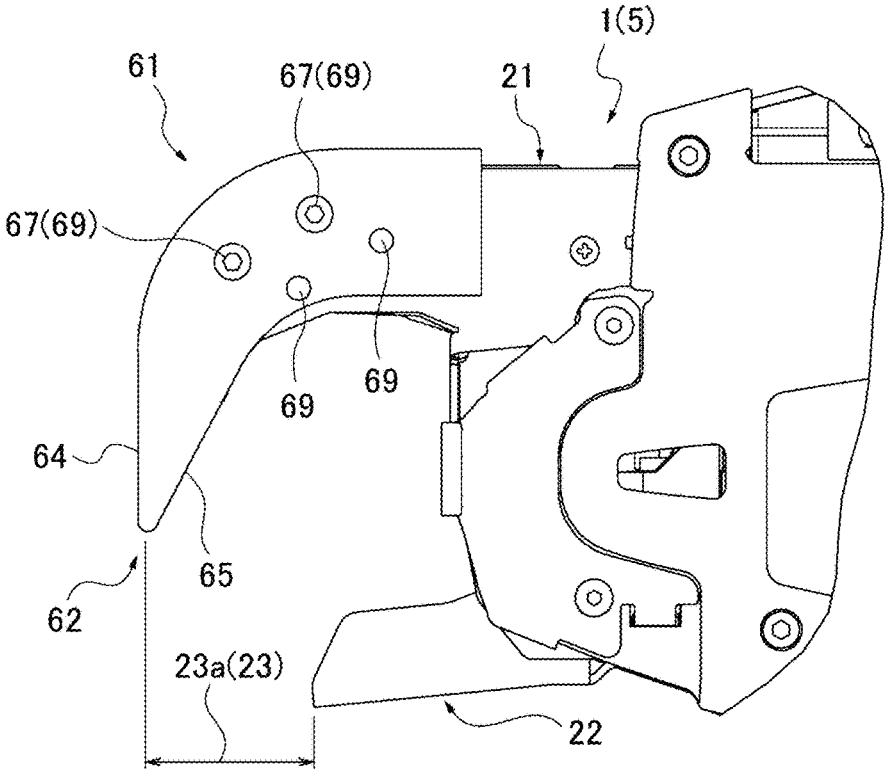
FIG. 13A is a side view of an embodiment of the auxiliary member for binding machine configured to be moveable relative to the upper curl guide, depicting a state before movement (before an opening is enlarged).
Figure 13B:
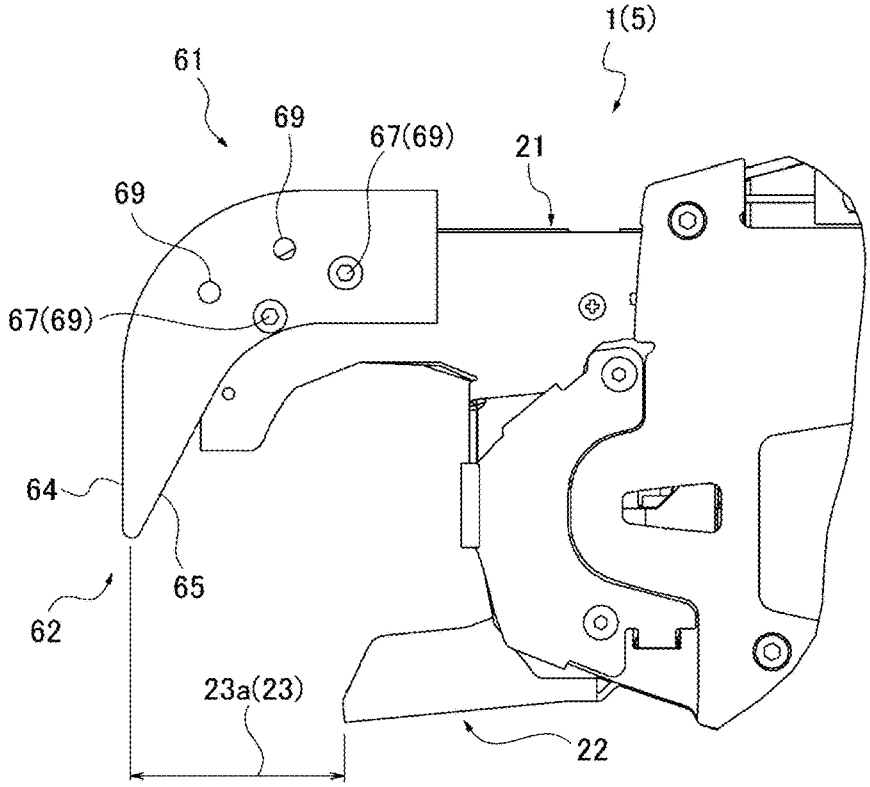
FIG. 13B is a side view depicting a state after movement of the auxiliary member for binding machine of FIG. 13A (after the opening is enlarged).

In order to change the size of the opening 23*a*, the protrusion 62 may be mounted so that it can be displaced (linearly) forward relative to the binding machine main body 5, as shown in the embodiment of FIGS. 13A and 13B. Also, as shown in the embodiment of FIGS. 15A and 15B, the protrusion 62 may be mounted so that it can be rotatable in a direction getting away from the opposite one of the curl guides 21, 22.

Meanwhile, in the embodiment of FIGS. 12A and 12B or the embodiment of FIGS. 14A and 14B, the size of the opening 23*a* can be changed. However, the corresponding embodiment is mainly configured to be switched to one of an aspect where the auxiliary member 61 for binding machine is used and an aspect where the auxiliary member 61 for binding machine is not used.

(9) As shown in the embodiment of FIG. 11, a protection part 71 configured to be continuous to the protrusion 62 and to cover at least a part of the outer surfaces of the curl guides 21, 22 from an outside may be provided.

Herein, the protection part 71 is a part configured to cover at least the outer surfaces of the tip end portions of the curl guides 21, 22 from the outside. The protection part 71 is preferably provided integrally with the protrusion 62 at a base part of the protrusion 62. The protection part 71 may be used as a mounting part 72 of the protrusion 62 to the curl guides 21, 22 or the like. On the other hand, the mounting part 72 may be provided separately from the protection part 71.

That is, during the binding operation, when the curl guides 21, 22 collide with the binding target 6, the ground, a wall or the like, the curl guides 21, 22 may be damaged. Thereby, a malfunction such as a curl formation defect of the wire 9, a jamming of the wire 9 and the like may be caused. Therefore, for example, as shown in FIGS. 25A to 25C, when the protection part 71 configured to protect surfaces including the tip end portions of the curl guides 21, 22 is provided, it is possible to protect the damage of the curl guides 21, 22 and to prolong the lifetime of the curl guides 21, 22.

Also, in this embodiment, the protection part 71 is arranged at a position including the surface for protecting the tip end portions of the curl guides 21, 22. However, the protection part 71 may be appropriately arranged at the tip end portions of the curl guides 21, 22, the outer peripheral surfaces thereof or the like.

Figure 25A:
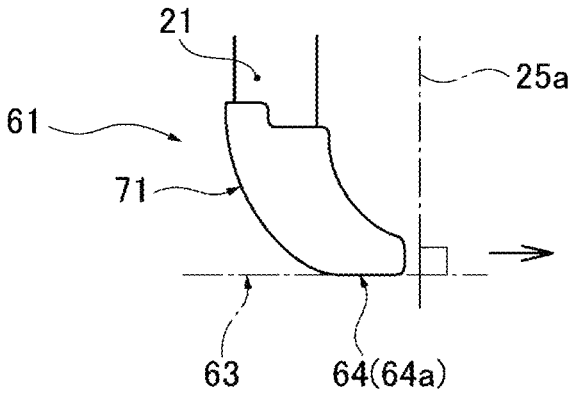
FIG. 25A is a partially enlarged view of FIG. 9, depicting the guide part provided at a protection part.
Figure 25B:
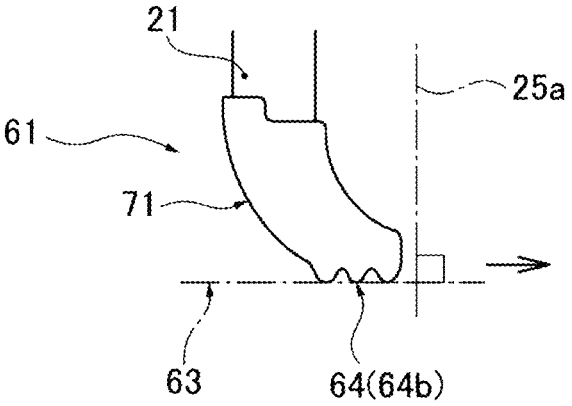
FIG. 25B is a partially enlarged view of FIG. 9, depicting another example of the guide part provided at the protection part.
Figure 25C:
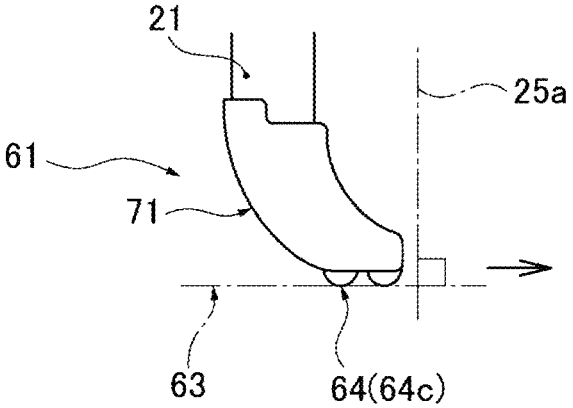
FIG. 25C is a partially enlarged view of FIG. 9, depicting another example of the guide part provided at the protection part.

In the meantime, structurally, the protection part 71 may be directly provided with the guide part 64 such as a linear guide part 64*a* having a linear portion, as shown in FIG. 25A, a concavo-convex guide part 64*b* having a concavo-convex portion, as shown in FIG. 25B, or a two-point-like guide part 64*c* having two-point protrusions, as shown in FIG. 25C. In the below, the protection part 71 is described in detail.

(9-1) The protection part 71 may have a protection surface 73 configured to protect at least one of surfaces (an outer periphery-side surface 32 and both side surfaces 33, 34) configuring the curl guides 21, 22.

Herein, the protection surface 73 is at least one of the surfaces configuring the curl guides 21, 22. That is, for example, the protection surface 73 may be the outer periphery-side surface 32 of the curl guides 21, 22. The protection surface 73 may be the right side surface 33 of the curl guides 21, 22. The protection surface 73 may be the left side surface 34 of the curl guides 21, 22. Preferably, following configurations are possible.

Figure 16:
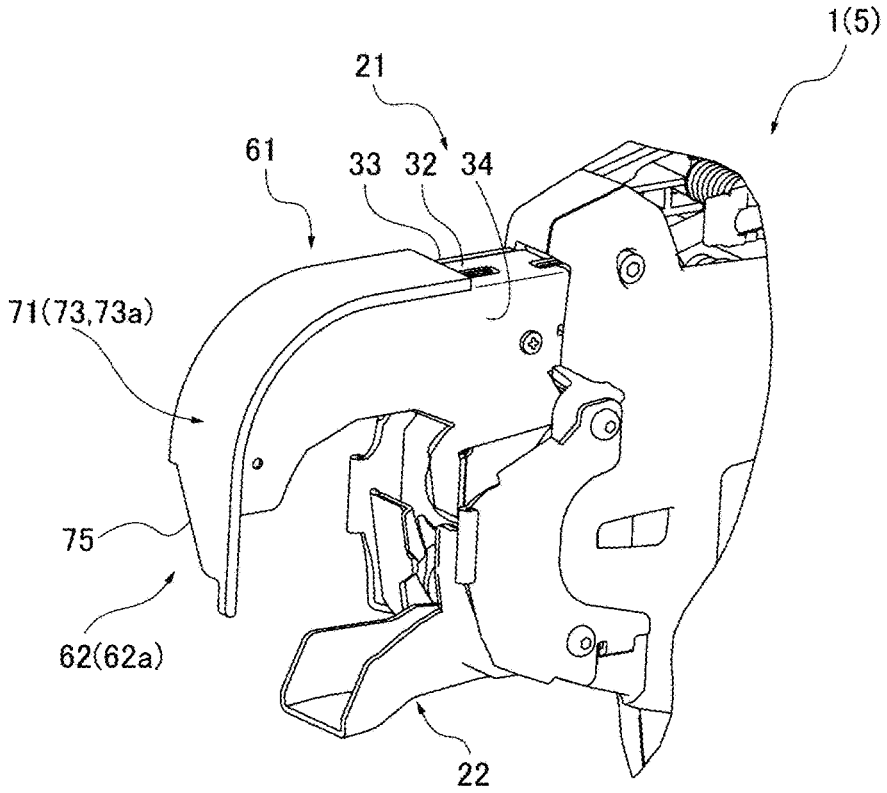
FIG. 16 is a perspective view depicting an embodiment of the auxiliary member for binding machine having only an outer periphery protection surface as a protection part.

(10) More specifically, as shown in an embodiment of FIG. 16, the protection part 71 may have an outer periphery protection surface 73*a* configured to cover the outer periphery-side surface 32 of the outer surfaces of the curl guides 21, 22.

Herein, the protection part 71 has only the outer periphery protection surface 73*a* to protect at least a part of one surface of the curl guides 21, 22. The outer periphery protection surface 73*a* has a curved and substantial band shape having a width size, which is equal to or slightly greater than the outer periphery-side surface 32 of the curl guides 21, 22, and extending along the outer periphery-side surface 32. In this case, the protrusion 62 may be configured to have only an outer periphery constituting surface 62*a* extending integrally from the outer periphery protection surface 73*a*.

Figure 17:
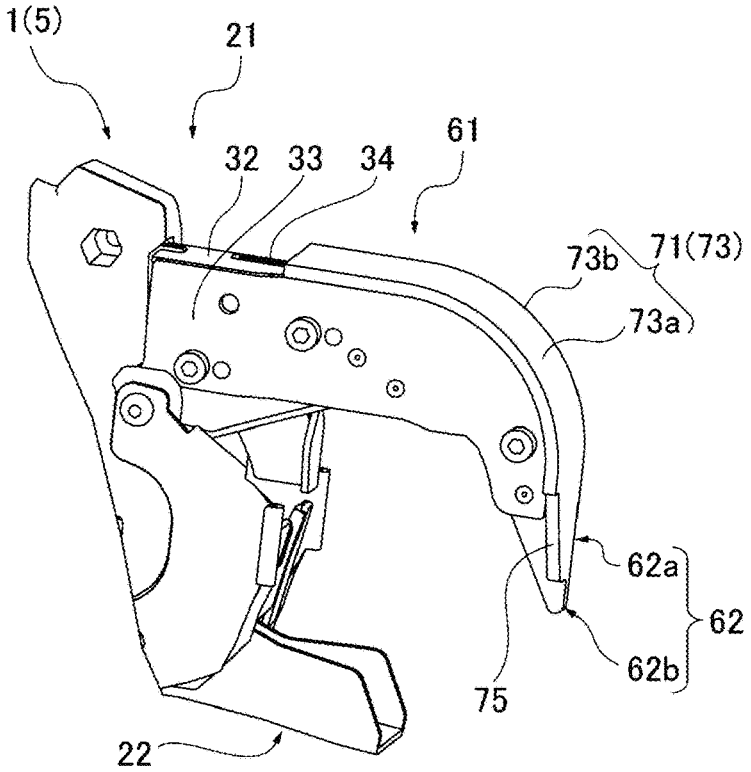
FIG. 17 is a perspective view depicting an embodiment of the auxiliary member for binding machine having an outer periphery protection surface and one side surface protection surface, as a protection part.

(11) As shown in an embodiment of FIG. 17, the protection part 71 may have an outer periphery protection surface 73*a* configured to cover the outer periphery-side surface 32 of the outer surfaces of the curl guides 21, 22 and a side surface protection surface 73*b* configured to cover one of the side surfaces 33, 34 of the curl guides 21, 22.

Herein, the protection part 71 is configured to protect at least a part of two surfaces of the curl guides 21, 22 by the outer periphery protection surface 73*a* and one side surface protection surface 73*b*. The side surface protection surface 73*b* may be configured to cover the right side surface 33. The side surface protection surface 73*b* may be configured to cover the left side surface 34. In this embodiment, the side surface protection surface 73*b* covers the left side surface 34. In this case, the protrusion 62 may be configured to have an L-shaped section having an outer periphery constituting surface 62*a* extending from the outer periphery protection surface 73*a* and a side constituting surface 62*b* extending from one side surface protection surface 73*b*.

(12) As shown in the embodiment of FIG. 11, the protection part 71 may be configured to have a C-shaped or U-shaped section part having the outer periphery protection surface 73*a* configured to cover the outer periphery-side surface 32 of the outer surfaces of the curl guides 21, 22 and a pair of side surface protection surfaces 73*b*, 73*b* configured to cover both the side surfaces 33, 34.

Herein, the protection part 71 is configured to protect at least a part of three surfaces of the curl guides 21, 22 by the outer periphery protection surface 73*a* and the pair of side surface protection surfaces 73*b*, 73*b*. In this case, the protrusion 62 may be configured to have a C-shaped or U-shaped section having an outer periphery constituting surface 62*a* extending from the outer periphery protection surface 73*a* and a pair of side constituting surfaces 62*b*, 62*b* extending from both the side surface protection surfaces 73*b*, 73*b*.

(13) For example, as shown in the embodiment of FIG. 16, the protrusion 62 may have an outer periphery constituting surface 62*a* configuring an outer periphery-side surface, and the outer periphery constituting surface 62*a* may have a width-narrowed part 75 of which a width gradually decreases toward a tip end-side.

(14) The protrusion 62 may have a pair of side constituting surfaces 62*b*, 62*b* configuring side surfaces, and the width-narrowed part 75 may have a shape tapered toward one side constituting surface 62*b*.

(15) The protrusion 62 may have a pair of side constituting surfaces 62*b*, 62*b* configuring side surfaces, and the side constituting surfaces 62*b*, 62*b* may have a shape tapered toward a tip end-side.

Herein, the width-narrowed part 75 is a part formed by tapering a width of the tip end portion of the protrusion 62. The width-narrowed part 75 may be a part formed by narrowing a width of the outer periphery constituting surface 62*a* toward the tip end-side. In this case, the width-narrowed part 75 is a part (one-side inclined part) formed by inclining the outer periphery constituting surface 62*a* in a tapered shape toward the left side surface 34.

Figure 18A:
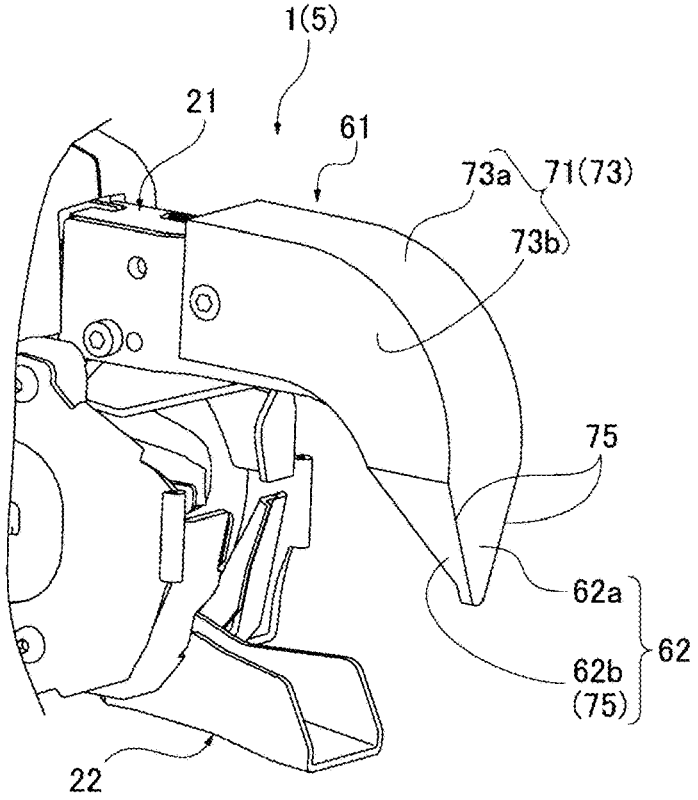
FIG. 18A is a perspective view depicting an embodiment of the auxiliary member for binding machine having a width-narrowed part, as seen from a right side.
Figure 18B:
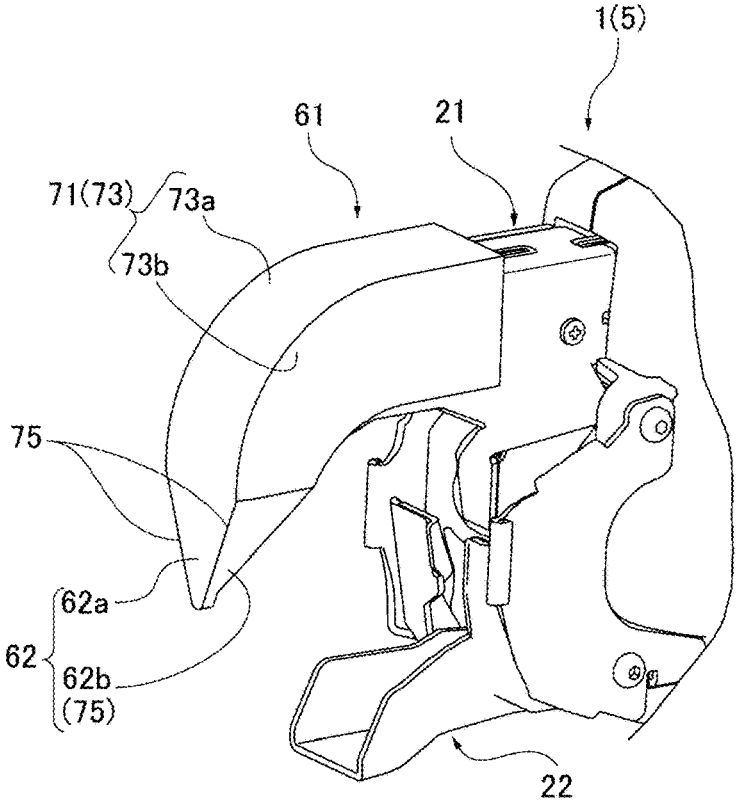
FIG. 18B is a perspective view of FIG. 18A, as seen from a left side.

Also, for example, as shown in an embodiment of FIGS. 18A and 18B, the width-narrowed part 75 may be a part formed by narrowing a width of the outer periphery constituting surface 62*a* and reducing inward the side constituting surfaces 62*b*, 62*b* in conformity to the tapered shape of the outer periphery constituting surface 62*a*. In this case, the width-narrowed part 75 is a part (both-side inclined part) formed by inclining the outer periphery constituting surface 62*a* in a tapered shape toward a width center part.

Figure 19:
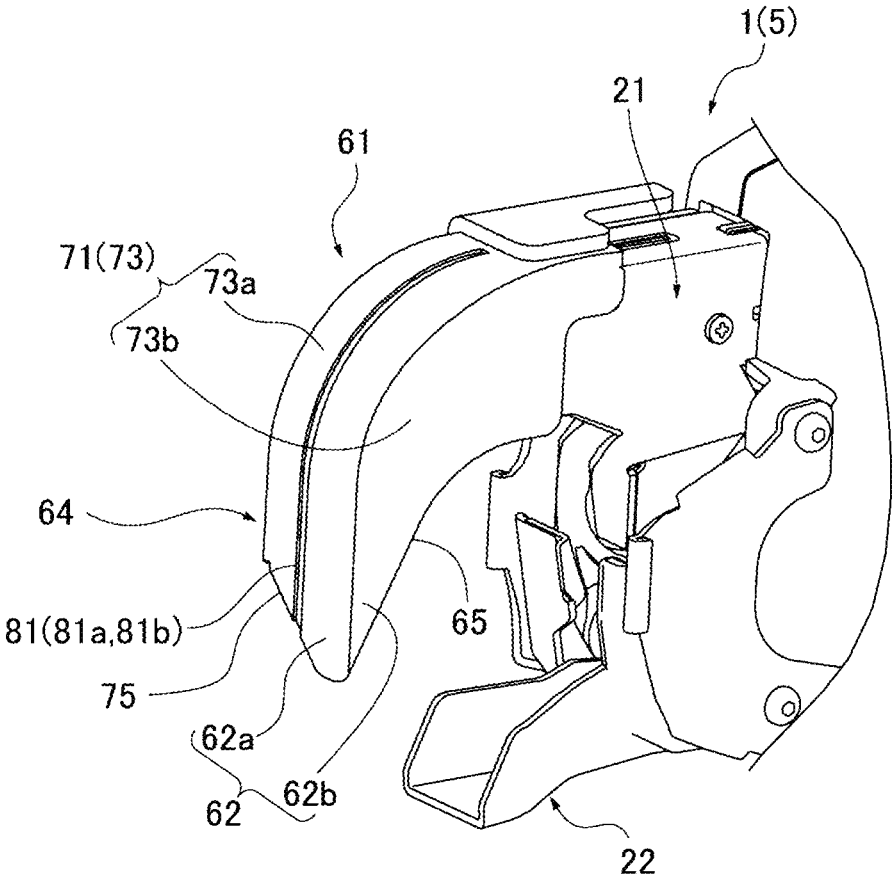
FIG. 19 is a perspective view depicting an embodiment of the auxiliary member for binding machine having a mark.

(16) As shown in an embodiment of FIG. 19, the protrusion 62 may be configured to have a mark 81 indicative of a position, through which the wire 9 is to pass, on an outer periphery or inner periphery-side surface.

Herein, the mark 81 is provided at least at a position of the outer periphery constituting surface 62*a*, which can be easily seen (by an operator of the binding machine 1). Any mark 81 may be provided as long as a position through which the wire 9 is to pass can be seen by the mark. The mark 81 may be configured by a letter, a symbol and the like. The width-narrowed part 75 can also be used as a kind of the mark 81. Specifically, following configurations are possible.

(16-1) The mark 81 may be configured by a projection portion 81*a* or a concave portion 81*b*.

Herein, the projection portion 81*a* is a portion protruding outward from the outer periphery constituting surface 62*a*. The concave portion 81*b* is a portion recessed inward from the outer periphery constituting surface 62*a*. The projection portion 81*a* or the concave portion 81*b* may have a short point shape. As shown in the embodiment of FIG. 19, the projection portion 81*a* or the concave portion 81*b* may have a long line shape such as a projection, a concave recess (refer to the concave recess 64*e* of FIG. 10A, too), or the like. Also, the projection portion 81*a* or the concave portion 81*b* may have a shape obtained by appropriately combining linear shapes. In this embodiment, the projection portion 81*a* or the concave portion 81*b* is configured as a projection or a concave recess provided at a width intermediate part between the outer periphery constituting surface 62*a* of the protrusion 62 and the outer periphery protection surface 73*a* of the protection part 71 and extending in the front and back direction 2.

(16-2) The mark 81 may be provided on the outer periphery-side or inner periphery-side of the protrusion 62.

Herein, the mark 81 may be provided (at a position that is easy to see) on any one of the outer periphery-side (front surface-side) of the protrusion 62 and the inner periphery-side (back surface-side) of the protrusion 62. Also, the mark 81 may be provided on both the outer periphery-side of the protrusion 62 and the inner periphery-side of the protrusion 62. For example, the projection portion 81*a* and the concave portion 81*b* becoming the mark 81 may be provided at the same time on both the outer periphery-side of the protrusion 62 and the inner periphery-side of the protrusion 62 by performing concavo-convex processing of making a plate thickness substantially constant for a metal plate configuring the protrusion 62. In this case, one of the projection portion 81*a* and the concave portion 81*b* is provided on the outer periphery-side of the protrusion 62, and the other is provided on the inner periphery-side of the protrusion 62.

(16-3) As shown in the embodiment of FIG. 11, the protrusion 62 may be mounted and fixed to a mounting member 85 provided at a position deviating from the locus 31 (refer to FIG. 9) for guiding the wire 9 in the loop shape within the curl guides 21, 22.

Herein, the mounting member 85 may be configured by a metallic reinforcement plate (a screw receiving plate) having a screw hole 86 in which a screw as the dedicated fixing tool 67 is to be screwed, for example. The mounting member 85 is mounted to an inner surface of one side surface 33 of the upper curl guide 21, for example.

Figure 20:
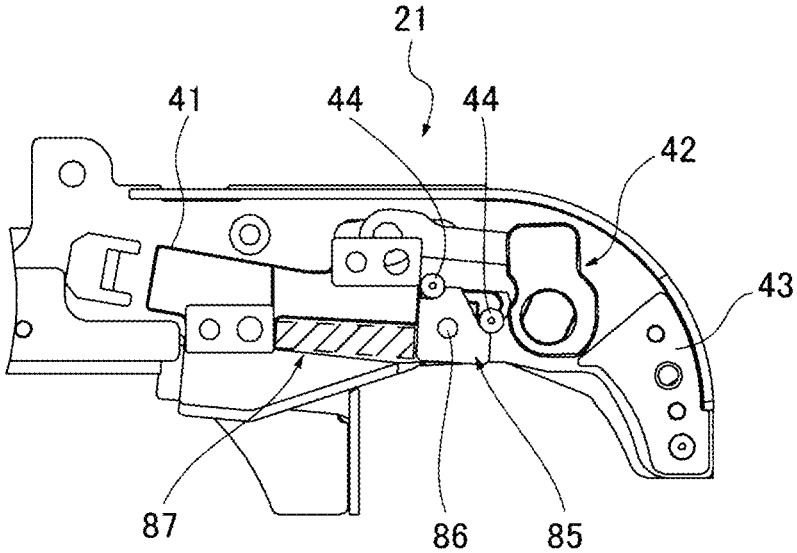
FIG. 20 is a side view depicting an internal structure of the upper curl guide similar to FIG. 4, showing a position at which a mounting member can be mounted.

For example, as shown in FIG. 20, the mounting member 85 may be mounted at a position closer to the inner periphery than a wire guide member 44 (a member for wear prevention) between a guide member 41 and a cutting part 42 within the upper curl guide 21.

Alternatively, the mounting member 85 may be mounted to a part 87 shown with hatched lines, which is closer to the inner periphery than the guide member 41, within the upper curl guide 21.

The above parts are positions through which the wire 9 is not to pass, and are also positions avoiding a moveable region of the cutting part 42 and a region in which the wire 9 is to be curled by the curl plate 43 and the like.

(16-4) As shown in the embodiment of FIG. 11, the protrusion 62 may be mounted to the curl guides 21, 22. In this case, the curl guides 21, 22 may be configured so that at least a part, to which the protrusion 62 is mounted, can be replaced.

Herein, as described above, the curl guides 21, 22 have the outer periphery-side surface 32 and the pair of right and left side surfaces 33, 34. For example, the outer periphery-side surface 32 may be configured as a member integrated with the left side surface 34, and a member configuring the right side surface 33 may be detachably attached thereto by a fixing tool 89. The fixing tool 89 may be configured by a screw extending in the width direction 4, for example.

The protrusion 62 may be configured so that the protection part 71 or a mounting part 72 provided for the protection part 71 is to be mounted to one side surface 33 of the curl guides 21, 22 by using the dedicated fixing tool 67 (screw) or the like.

In this way, the curl guides 21, 22 can be demounted and replaced from the binding machine main body 5 with the protrusion 62 being mounted. Alternatively, the protrusion 62 can be demounted and replaced from the binding machine main body 5 with being mounted to the curl guides 21, 22.

Also, when the fixing tool 89 is unfastened with the dedicated fixing tool 67 (screw) being screwed, one side surface 33 can be demounted from the other parts (the outer periphery-side surface 32 and the left side surface 34) of the curl guides 21, 22 fixed to the binding machine main body 5, together with the protrusion 62. Alternatively, the protrusion 62 can be demounted and replaced from the other parts (the outer periphery-side surface 32 and the left side surface 34) of the curl guides 21, 22 with being mounted to one side surface 33, together with the one side surface 33.

Figure 21A:
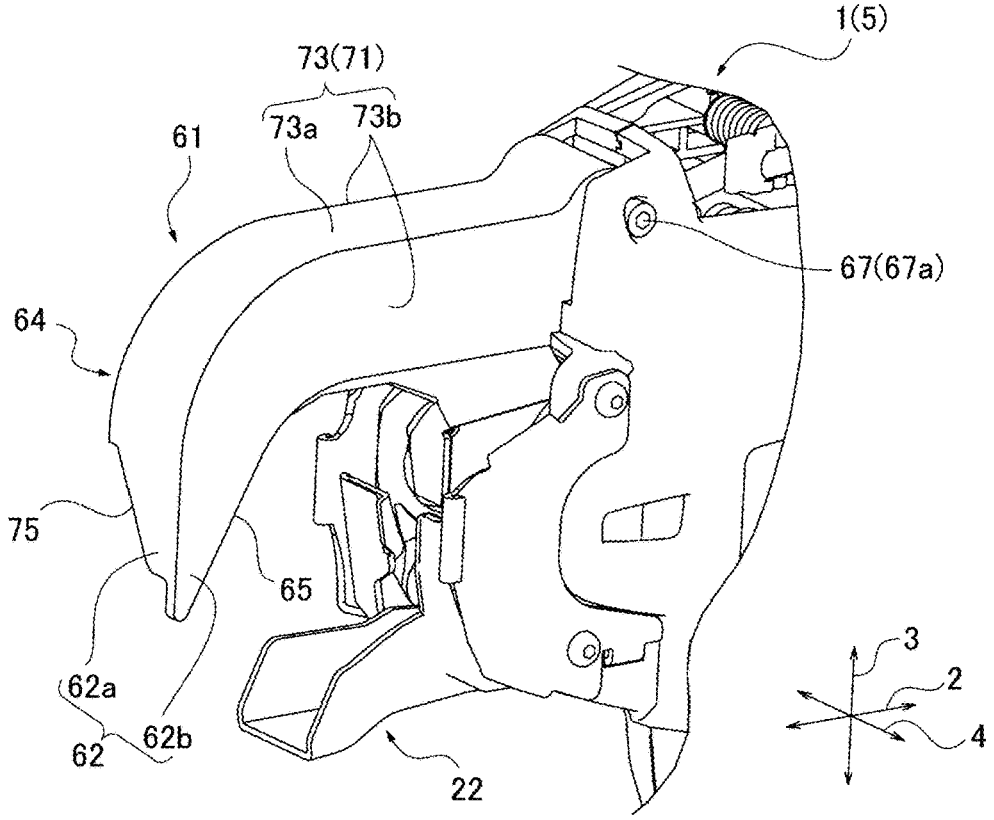
FIG. 21A is a perspective view depicting an embodiment of the auxiliary member for binding machine extending from a binding machine main body.
Figure 21B:
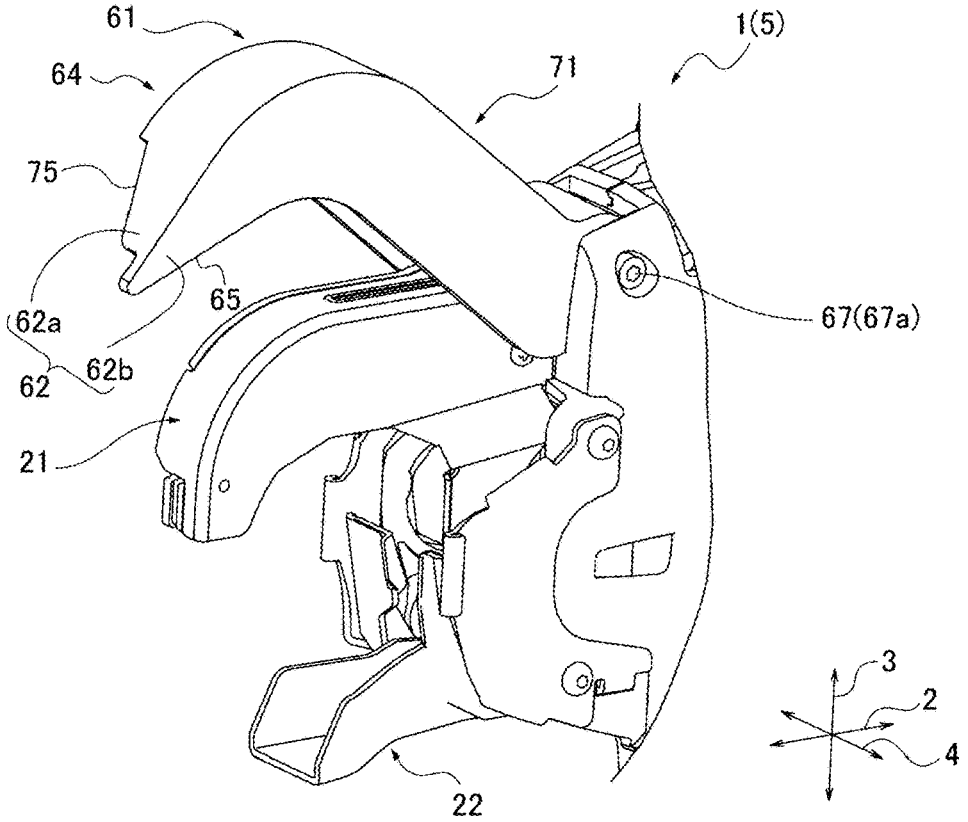
FIG. 21B is a perspective view depicting a state after the auxiliary member for binding machine of FIG. 21A is rotated relative to the binding machine main body (an aspect where the auxiliary member for binding machine is not used).

(16-5) As shown in an embodiment of FIGS. 21A and 21B, the protrusion 62 may be made to extend from the binding machine main body 5 configured to support the curl guides 21, 22.

Herein, the description "extending from the binding machine main body 5" indicates that the protrusion 62 is provided at a tip end portion of a part extending from the binding machine main body 5. Alternatively, the description "extending from the binding machine main body 5" indicates a state where the protection part 71 integrally provided at the base end-side (a side facing toward the binding machine main body 5) of the protrusion 62 covers the entire curl guides 21, 22, extends to reach the binding machine main body 5 and is directly mounted to the binding machine main body 5 and thus the protrusion extends from the binding machine main body 5.

In this embodiment, the protection part 71 has a C-shaped or U-shaped section having the outer periphery protection surface 73*a* and a pair of side surface protection surfaces 73*b* and covers the entire upper curl guide 21.

Also, the protrusion 62 is mounted so that a base part of the protection part 71 can be vertically rotatable relative to the binding machine main body 5 by the rotation shaft 67*a* extending in the width direction 4. Thereby, it is possible to change a shape of the binding machine 1 to any one of a state where there is the protrusion 62 and a state where there is no the protrusion 62.

Furthermore, the protrusion 62 has the width-narrowed part 75 on the outer periphery constituting surface 62*a*.

(17) The protrusion 62 may be provided on at least one side surface 33 or side surface 34 of the outer surfaces of the curl guides 21, 22.

In each embodiment of FIGS. 5 to 21B, the protrusion 62 is provided on the outer surface of the curl guides 21, 22, and can be provided on at least one side surface 33 or side surface 34.

Figure 22A:
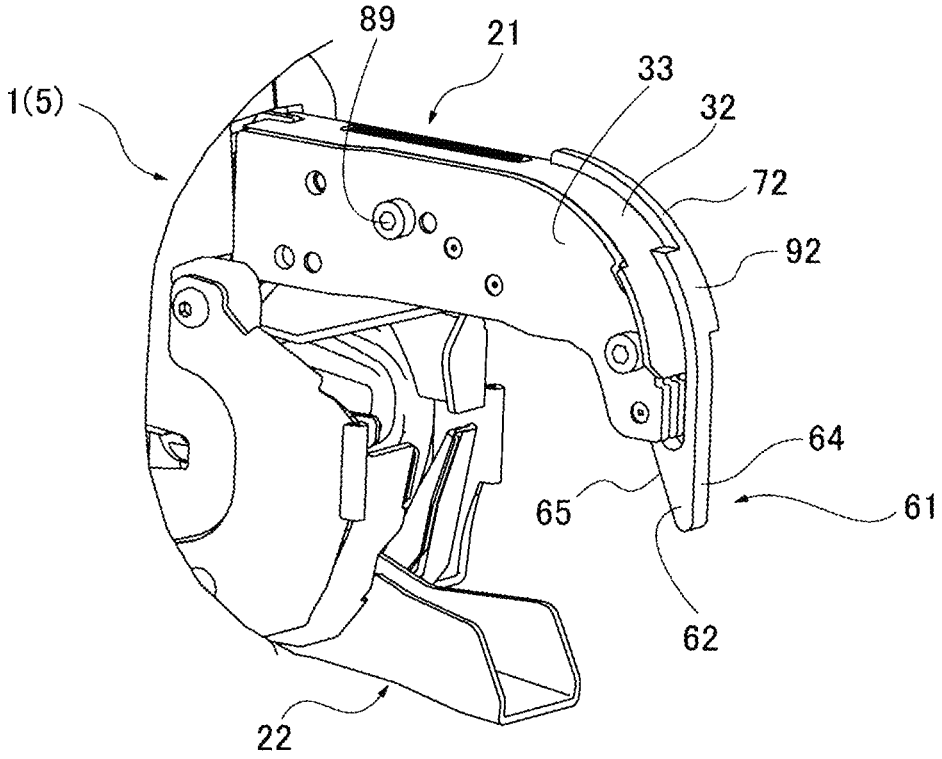
FIG. 22A is a perspective view depicting an embodiment of the auxiliary member for binding machine mounted inside the curl guide.
Figure 22B:
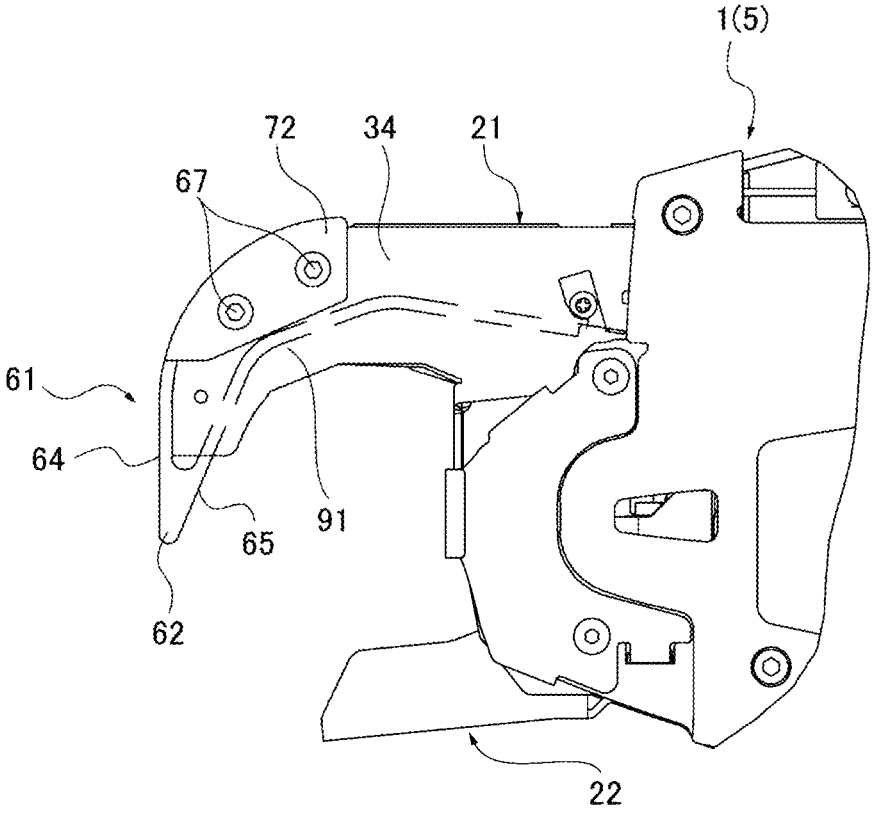
FIG. 22B is a left side view of FIG. 22A.
Figure 22C:
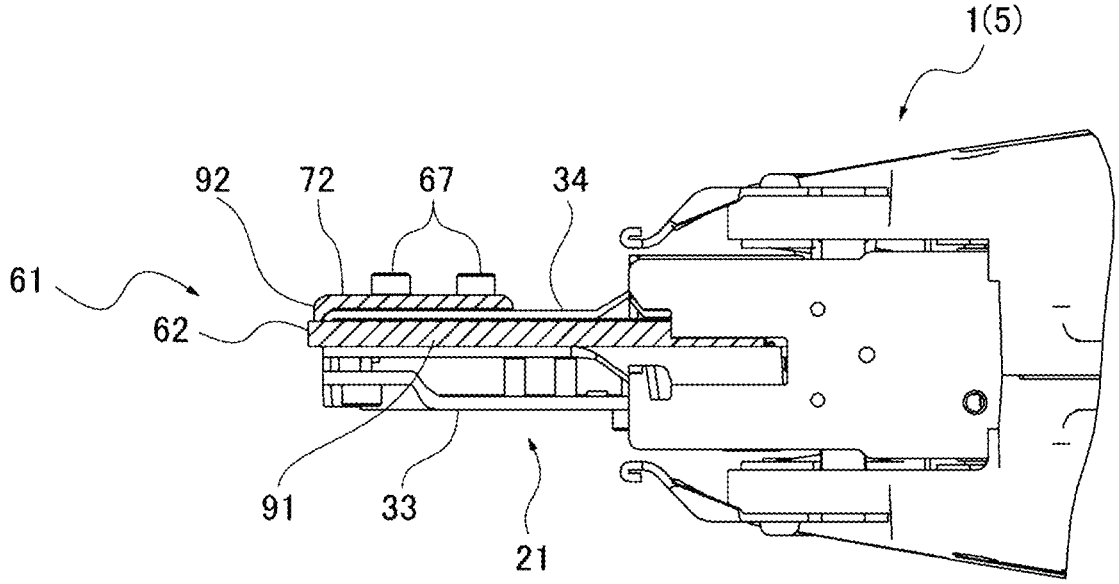
FIG. 22C is a bottom view of FIG. 22A.
Figure 23:
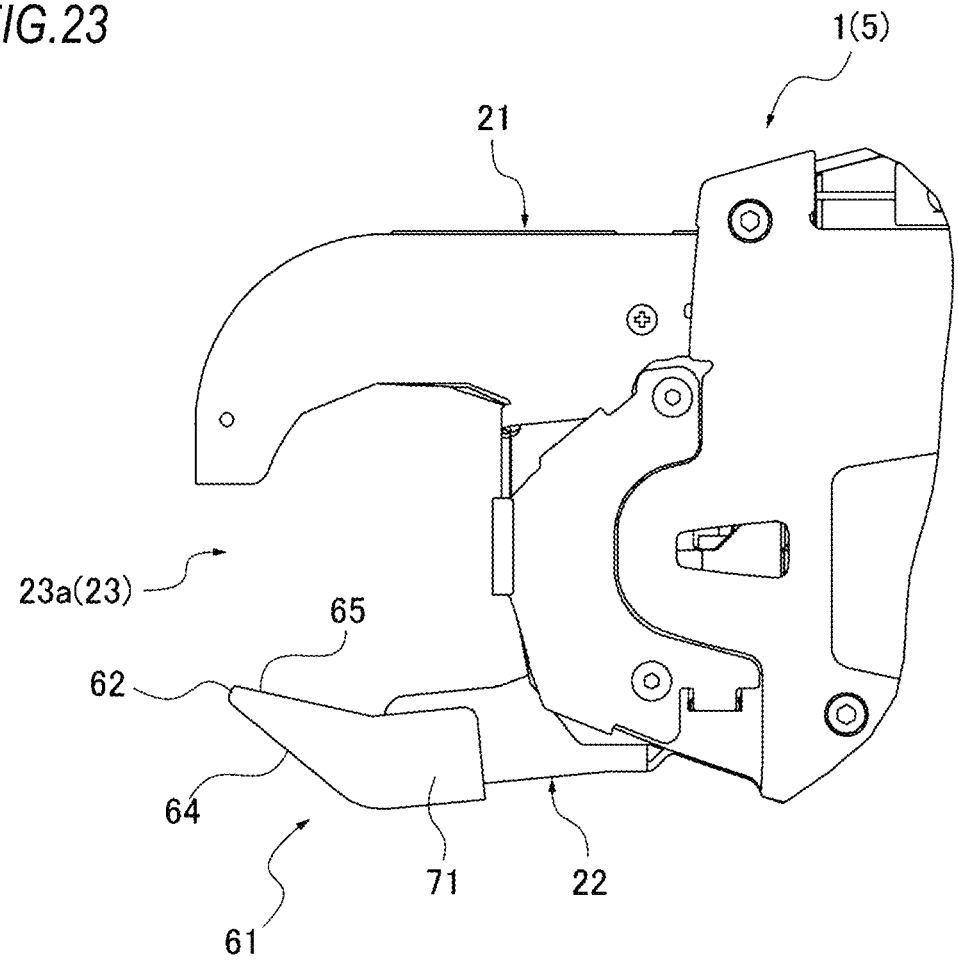
FIG. 23 is a side view depicting an embodiment of the auxiliary member for binding machine mounted to a lower curl guide.

(17-1) Also, as shown in an embodiment of FIGS. 22A to 22C, the protrusion 62 may be mounted at an inner side of the curl guides 21, 22.

Herein, the description "mounted at the inner side of the curl guides 21, 22" indicates that the protrusion 62 is mounted at a state where the protrusion 62 or at least a portion of a part provided integrally with the protrusion 62 is positioned inside the curl guides 21, 22.

In this embodiment, the protrusion 62 has a surface parallel with the right and left side surfaces 33, 34 of the curl guides 21, 22. The protrusion 62 has an integrated extension part 91 (refer to FIG. 22B) that is provided at the base end-side thereof and can be inserted and arranged in the curl guides 21, 22. The extension part 91 has a length that substantially reaches the binding machine main body 5. Also, the protrusion 62 is coupled to the mounting part 72 via a coupling part 92. The mounting part 72 has a surface positioned outside the side surface 34 of the curl guides 21, 22 and parallel with the side surface 34. The mounting part 72 can be detachably fixed to the side surface 34 from an outside by using the dedicated fixing tool 67. In the meantime, the mounting part 72 may be configured to have a size and a shape becoming the protection part 71 configured to protect the side surface 34 of the curl guides 21, 22.

In the above descriptions, the protrusion 62 (and the protection part 71) is mounted to the upper curl guide 21. However, as shown in an embodiment of FIG. 23, the protrusion 62 (and the protection part 71) having a similar function may be mounted to the lower curl guide 22. In this case, an angle, a length and the like of the guide part 64 may be optimized so that it can be easily used in conformity to the lower curl guide 22.

Also, in the drawings, the reference numerals are omitted for convenience sake, and each embodiment may have the configurations shown in the other embodiments, as required.

(18) The auxiliary member 61 for binding machine may be mounted to the curl guides 21, 22 configured to guide the wire 9 in the loop shape around the binding target 6 or to the binding machine main body 5 configured to support the curl guides 21, 22. The auxiliary member 61 for binding machine has the tapered protrusion 62 that is positioned at the tip end-side of the curl guides 21, 22 when the auxiliary member is mounted to the curl guides 21, 22 or the binding machine main body 5. The auxiliary member 61 for binding machine may be configured to be detachably mounted to the curl guides 21, 22 or the binding machine main body 5.

(19) The protrusion 62 may have the guide part 64 at the outer periphery-side, which is arranged substantially perpendicularly to the extension line 25*a* of the shaft 25 of the twisting part 24 configured to bind the binding target 6 by twisting the wire 9 guided in the loop shape around the binding target 6.

<Operations>

In the below, the operations of the embodiments are described.

In the binding machine 1, at a state where the reel 11 is set to the mounting part 12 and a power supply is ON, the binding target 6 such as reinforcing bars is inserted between the pair of upper and lower curl guides 21, 22 from the opening 23, and the trigger switch 8 is pulled, so that the binding target 6 is bound by the wire 9.

At this time, the pair of feeding rollers 17 of the feeding part 15 is first rotated, so that the wire 9 wound on the reel 11 is pulled out from the reel 11 and is sent into the upper curl guide 21 via the guide member 41. Then, in the upper curl guide 21, the wire 9 sent from the guide member 41 is curled by the curl plate 43 and is delivered toward the lower curl guide 22. The lower curl guide 22 receives the wire 9 from the upper curl guide 21 and circulates the wire around the binding target 6. Thereby, the wire 9 is curled by the pair of upper and lower curl guides 21, 22, the wire 9 is guided in the loop shape around the binding target 6, and the wire 9 is circulated one or more times around the binding target 6. When the wire 9 formed in the loop shape is sent by a predetermined amount, it is cut at the cutting part 42. Further, the wire 9 is twisted by the twisting part 24 with being wound around the binding target 6, so that a diameter of the loop is reduced. By the above processes, the binding target 6 is bound.

When binding the binding target 6 arranged to be in contact with the surface (the contact surface 63) such as a floor, a wall or the like by using the binding machine 1, it is necessary to lift the binding target 6 with a hand opposite to a hand carrying the binding machine 1 or to forcibly scoop up the binding target 6 with the exposed curl guides 21, 22 of the binding machine 1, which increases the operation burden.

<Effects>

According to the embodiments, following effects can be accomplished by the above configurations.

(Effect 1)

As shown in FIGS. 8 and 9, the curl guides 21, 22 have the protrusion 62 having a tapered shape (for example, a claw shape) at the tip end-side. Thereby, when the binding machine 1 is moved as it scrapes the contact surface 63 with the protrusion 62, it is possible or easy to directly scoop up the binding target 6 in contact with the contact surface 63 by the binding machine 1 (having the protrusion 62). Therefore, when binding the binding target 6 in contact with the contact surface 63, it is not necessary to lift the binding target 6 with a hand opposite to a hand holding the binding machine 1 or to forcibly scoop up the binding target 6 by the exposed curl guides 21, 22 (of the binding machine 1 without the protrusion 62), so that it is possible to easily perform the binding operation with one hand. As a result, it is possible to reduce the operation burden and to shorten the operation time.

At this time, since the guide part 64 is provided at the outer periphery-side of the protrusion 62, when the binding machine 1 is moved in one extension direction of the guide part 64 along the contact surface 63 while keeping the contact state of the guide part 64 with the contact surface 63, it is possible to stably move the binding machine 1 and to keep the protrusion 62 at the most favorable state where it is possible to scoop up the binding target 6. Therefore, it is possible to easily and securely scoop up the binding target 6.

(Effect 2)

The guide part 64 is arranged substantially perpendicularly to the extension line 25*a* of the shaft 25 of the twisting part 24 of the binding machine 1. Thereby, when the guide part 64 is contacted to the contact surface 63, since the binding machine main body 5 is substantially perpendicular to the contact surface 63, it is possible to smoothly scoop up the binding target 6 on the ground without turning over the wrist and to perform the operation with a posture at which the load is least applied to the wrist carrying the binding machine 1. Also, the guide part 64 becomes a length to exactly contact the contact surface 63, so that it can optimally stabilize the linear movement of the binding machine 1. Therefore, it is possible to configure the favorable guide part (i.e., the guide part capable of effortlessly and securely scooping up the binding target 6) simply by moving the protrusion 62 along the contact surface 63.

In contrast, for example, in case that a linear part similar to the linear guide part 64*a* of FIG. 24A or 25A is provided at an angle (for example, an angel sufficiently greater or smaller than 90°) different from the above, when it is intended to bring the linear part into linear contact with the contact surface 63, the binding machine main body 5 is largely inclined relative to the contact surface 63, so that the wrist is unnaturally bent. Thereby, the linear part cannot be used or is difficult to be used as the guide part configured to move with being in contact with the contact surface 63. In addition, it is not possible to skillfully scoop up the binding target 6 simply by linearly moving the protrusion 62 along the contact surface 63.

For this reason, for example, it is necessary to jointly use the complex movement of linearly moving the binding machine 1 so as to insert the tapered protrusion 62 between the contact surface 63 and the binding target 6 and then scooping up the binding target 6 by using a lever principle.

However, when the guide part 64 is arranged to be substantially perpendicular to the shaft 25 of the twisting part 24 of the binding machine 1, like the above embodiment, it is possible to simply scoop up the binding target 6 just by linearly moving the binding machine 1 along the guide part 64 and it is not necessary to perform the movement using the lever principle. Therefore, during the operation, it is possible to reduce the fatigue and the burden on the wrist and the like, so that it is possible to reduce the wrist pain.

Also, for example, since it is not necessary to lift the binding target 6 in contact with the contact surface 63 with the hand (opposite to the hand carrying the binding machine 1) or to forcibly scoop up the binding target 6 by bringing the exposed curl guides 21, 22 (of the binding machine 1 without the protrusion 62) into direct contact with the contact surface 63, so that it is possible to prevent problems that a fingertip or a glove is damaged or the curl guides 21, 22 are worn, deformed or distorted. As a result, it is possible to prevent a problem that a malfunction such as a curl defect of the wire 9 and a jamming of the wire 9 due to the damage of the curl guides 21, 22 is likely to occur, and to reduce the number of replacement times of the curl guides 21, 22.

In the meantime, the situation where the binding target 6 in contact with the contact surface 63 is to be bound actually occurs at a construction site of floor heating, for example. Even in this case, since it is possible to stably bind a mesh bar (the binding target 6) and a pipe for heating on the contact surface 63 such as a concrete floor, it is possible to securely speed up the operation. The contact surface 63 is not limited to the horizontal surface such as a floor, and may be a vertical surface such as a wall and the other surfaces, for example.

(Effect 3)

As shown in FIG. 11, the protrusion 62 may be detachably mounted to the curl guides 21, 22 or the binding machine 1. Thereby, for example, when the protrusion 62 is used to scoop up the binding target 6 and is thus damaged, it is possible to simply replace the protrusion 62. At this time, since it is sufficient to replace only the protrusion 62, it is possible to restore the function of the protrusion 62 easily and inexpensively. Also, since the protrusion 62 is detachably mounted, it is possible to dividedly use the binding machine 1 for a case where the protrusion 62 is required and for a case where the protrusion 62 is not required, so that it is possible to widen the uses of the binding machine 1. Furthermore, the detachable protrusion 62 can be mounted to the existing binding machine 1 so as to add the scoop-up function.

In contrast, for example, when the protrusion 62 provided as a separate member is fixed to the curl guides 21, 22, the binding machine 1 or the like so as not to be detachable, the binding machine 1 becomes a dedicated device for scoop-up, so that it cannot be used by a normal using method.

(Effect 4)

The guide part 64 may be configured as a planar surface. For example, when the guide part 64 is configured as the linear guide part 64*a* having a linear portion as shown in FIG. 24A, it is possible to most smoothly guide the guide part along the contact surface 63.

(Effect 5)

The guide part 64 may be configured as a planar surface having a convex portion or a concave portion. For example, when the guide part 64 is configured as the concavo-convex guide part 64*b* having a concavo-convex portion as shown in FIG. 24B or a two-point-like guide part 64*c* having two-point projections as shown in FIG. 24C, as compared to the linear guide part 64*a* shown in FIG. 24A, it is possible to reduce a contact area with the contact surface 63, thereby reducing the frictional resistance.

(Effect 6)

The guide part 64 may be configured as a curved surface approximate to a planar surface. For example, when the guide part 64 is configured as a gently curved guide part 64*d*, which has a large radius of curvature and is similar to the linear guide part 64*a* shown in FIG. 24A, it is possible to smoothly guide the guide part along the contact surface 63, in the substantially similar manner to the planar surface configuration.

(Effect 7)

The inclined guide part 65 is provided at the inner periphery-side of the protrusion 62, so that it is possible to smoothly guide the binding target 6 from the tip end-side toward the base end-side via the inclined guide part 65.

(Effect 7-1)

The guide part 65 has the boundary part 65*p* at the position beyond the extension line 25*a* of the shaft 25 of the twisting part 24, and the boundary part 65*p* guides the binding target 6 from the outside toward the inside of the locus 31 of the wire 5, so that it is possible to widely secure the range in which it is possible to keep the binding target 6 inside the guide part 65. Therefore, it is possible to improve the stability when scooping up the binding target 6. Also, since the scooped-up position of the binding target 6 is close to the shaft 25 of the twisting part 24, it is also possible to improve the stability of the binding.

The part located closer to the tip end-side of the guide part 65 than the boundary part 65*p* is the part 65*a* positioned outside the locus 31 of the wire 5, and the part located closer to the base end-side of the guide part 65 than the boundary part 65*p* is the part 65*b* positioned inside the locus 31 of the wire 5, so that it is possible to securely and smoothly guide the binding target 6 to the inner side of the guide part 65 from the part 65*a* positioned outside the locus 31 of the wire 5 toward the part 65*b* positioned inside the locus 31 of the wire 5.

Thereby, for example, the substantially entire region of the inner periphery-side of the protrusion 62 is positioned outside the locus 31 of the wire 9 formed in the loop shape. As a result, it is possible to prevent a problem that the wire 9 is contacted to the binding target 6 entering the inside of the locus 31 from the outside thereof and the curl defect is thus caused when the wire is shifted from the protrusion 62 to the curl guides 21, 22, like a case where the inner periphery-side of the protrusion 62 does not have a function as the guide part 65.

(Effect 8)

As shown in the embodiments of FIGS. 12A to 15B, the protrusion 62 may be mounted to be displaceable relative to the curl guides 21, 22. Thereby, it is possible to change the shape of the binding machine 1 or to adjust the function of the protrusion 62 by using the displacement of the protrusion 62, without mounting and demounting the protrusion 62. For example, when the protrusion 62 is required or is not required, it is possible to dividedly use the binding machine 1 for an aspect where there is the protrusion 62 and for an aspect where there is no protrusion 62, so that it is possible to widen the uses of the binding machine 1.

(Effect 8-1)

As shown in the embodiment of FIGS. 14A and 14B (or FIGS. 15A and 15B), the protrusion 62 may be displaced by the rotation relative to the curl guides 21, 22. When the protrusion 62 is displaced by the rotation, it is possible to further increase an amount of the displacement of the protrusion 62 and to conceive a method of displacing the protrusion 62.

(Effect 8-2)

The protrusion 62 may be displaced by the sliding relative to the curl guides 21, 22. When the protrusion 62 is displaced by the sliding, the protrusion 62 is displaced with keeping the substantially constant posture, for example, so that the protrusion 62 can be displaced to refrain from interfering.

(Effect 8-3)

As shown in the embodiment of FIGS. 13A and 13B (or FIGS. 15A and 15B), the size of the opening 23 between the tip end portions of the curl guides 21, 22 (or the opening 23*a* between the tip end portion of the protrusion 62 and the tip end portions of the curl guides 21, 22) may be changed by the displacement of the protrusion 62. Thereby, it is possible to optimally adjust the size of the opening 23 (opening 23*a*) in correspondence to the diameter of the binding target 6.

(Effect 9)

As shown in the embodiment of FIG. 11, at least a part of the outer surfaces of the curl guides 21, 22 may be covered from the outside by the protection part 71 provided to continue to the protrusion 62. Thereby, it is possible to prevent the damage of the curl guides 21, 22 and to prolong the lifetime of the curl guides 21, 22. Therefore, it is possible to reduce the necessity of replacing the curl guides 21, 22.

(Effect 9-1)

The protection part 71 may have the protection surface 73 configured to protect at least one of the surfaces (the outer periphery-side surface 32 and both the side surfaces 33, 34) configuring the curl guides 21, 22. Thereby, it is possible to efficiently protect at least one of the surfaces configuring the curl guides 21, 22 by the protection surface 73.

(Effect 10)

As shown in the embodiment of FIG. 16, the protection part 71 may have the outer periphery protection surface 73*a* configured to cover the outer periphery-side surface 32 of the outer surfaces of the curl guides 21, 22. Thereby, it is possible to efficiently protect the outer periphery-side surface 32 of the curl guides 21, 22, which is most important to form the wire 9 in the loop shape, by the outer periphery protection surface 73*a*. Also, the outer periphery-side surface 32 of the curl guides 21, 22 is located at the center in the width direction 4 and both sides thereof are reinforced by the pair of right and left side surfaces 33, 34, so that the sufficient strength is secured. Therefore, even when the protection part 71 having the outer periphery protection surface 73*a* is mounted to the curl guides 21, 22, it is possible to keep the state where the curl guides 21, 22 are difficult to be deformed or damaged, so that it is possible to stably mount the protrusion 62 and the protection part 71 to the curl guides 21, 22.

In contrast, for example, when the protrusion 62 is fixed to only one side surface 33, 34 of the curl guides 21, 22 from the outside by welding or the like, one side surface 33, 34 of the curl guides 21, 22 may be distorted due to the welding heat and the strengths of the right and left side surfaces 33, 34 of the curl guides 21, 22 are unbalanced. As a result, the curl guides 21, 22 are likely to be deformed or damaged due to the protrusion 62.

(Effect 11)

As shown in the embodiment of FIG. 17, the protection surface 73 may have the L-shaped section part having the outer periphery protection surface 73*a* and the side surface protection surface 73*b* configured to cover at least one of the side surfaces 33, 34 of the outer surfaces of the curl guides 21, 22. Thereby, it is possible to efficiently protect the outer periphery-side surface 32 and one of the side surfaces 33, 34 of the curl guides 21, 22 by the L-shaped protection surface 73. Also, the protection part 71 is formed to have the L-shaped section having the outer periphery protection surface 73*a* and one side surface protection surface 73*b*, so that it is possible to keep the state where the curl guides 21, 22 are difficult to be deformed or damaged. Therefore, it is possible to stably mount the protrusion 62 and the protection part 71 to the curl guides 21, 22.

(Effect 12)

As shown in the embodiment of FIG. 11, the protection part 71 may have the C-shaped or U-shaped section part having the outer periphery protection surface 73*a* and the pair of side surface protection surfaces 73*b*, 73*b*. Thereby, the protection part 71 has the sectional shape, which is substantially the same as (substantially similar to) the tip end portions of the curl guides 21, 22, so that it is possible to protect the entire tip end portions of the curl guides 21, 22 more widely and more efficiently. Therefore, it is possible to increase the durability and wear resistance of the entire curl guides 21, 22, thereby efficiently preventing the damage and deformation of the curl guides 21, 22. Also, the protection part 71 is configured to have the C-shaped or U-shaped section having the outer periphery protection surface 73*a* and the pair of side surface protection surfaces 73*b*, 73*b*, so that it is possible to keep the state where the curl guides 21, 22 are more difficult to be deformed or damaged. Therefore, it is possible to more stably mount the protrusion 62 and the protection part 71 to the curl guides 21, 22.

(Effect 13)

As shown in the embodiment of FIG. 16 or FIGS. 18A and 18B, the protrusion 62 may have the outer periphery constituting surface 62*a* configuring the outer periphery-side surface, and the outer periphery constituting surface 62*a* may have the width-narrowed part 75 of which the width gradually decreases toward the tip end-side. Thereby, since the width-narrowed part 75 indicates the position through which the wire 9 is to pass, it is possible to easily check the position through which the wire 9 is to pass, and to improve the operability.

Also, the width-narrowed part 75 is provided at the tip end portion of the outer periphery-side of the protrusion 62, so that it is possible to make it difficult for the protrusion 62 to interfere with the binding target 6 at a part at which the binding targets 6 intersect with each other, and to bring the tip end portion of the protrusion 62 close to the part at which the binding targets 6 intersect with each other. Therefore, it is possible to correctly bind the binding targets at a position closer to the intersection part.

(Effect 14)

The protrusion 62 may have the pair of side constituting surfaces 62*b*, 62*b* configuring the side surfaces, and the width-narrowed part 75 may have a shape tapered toward one side constituting surface 62*b*.

(Effect 15)

The protrusion 62 may have the side constituting surfaces 62*b*, 62*b* configuring the side surfaces, and the side constituting surfaces 62*b*, 62*b* may have a shape tapered toward the tip end-side.

(Effect 16)

As shown in the embodiment of FIG. 19, the protrusion 62 may have the mark 81 on the outer periphery-side or inner periphery-side surface. Thereby, when the protrusion 62 is provided, it is possible to easily check the position through which the wire 9 is to pass, and to improve the operability.

(Effect 16-1)

The mark 81 may be configured by the projection portion 81*a* or the concave portion 81*b*. Thereby, the mark 81 can be configured so that it can be easily made and easily distinguished from the outside.

(Effect 16-2)

The mark 81 may be provided at the outer periphery-side or the inner periphery-side of the protrusion 62. Thereby, it is possible to provide the mark 81 at a position at which it is most noticeable during the operation.

(Effect 16-3)

As shown in the embodiment of FIG. 11 or FIG. 20, the protrusion 62 may be mounted and fixed to the mounting member 85 that is provided at the position deviating from the locus 31 along which the wire 9 in the curl guides 21, 22 is to be guided in the loop shape. Thereby, it is possible to provide the mounting member 85 within the curl guides 21, 22 without interfering with the loop-shaped locus 31 of the wire 9. Also, it is possible to secure the mounting strength of the curl guides 21, 22 to the protrusion 62 by the mounting member 85.

(Effect 16-4)

As shown in the embodiment of FIG. 11, the protrusion 62 may be directly mounted to the curl guides 21, 22. Thereby, it is possible to make the protrusion 62 small. At least the part of the curl guides 21, 22 to which the protrusion 62 is mounted may be configured to be replaceable. Alternatively, the protrusion 62 may be mounted to the replaceable part of the curl guides 21, 22. Thereby, it is possible to replace (at least a part of) the curl guides 21, 22 and the protection part 71 at one time and at relatively low cost.

(Effect 16-5)

As shown in the embodiment of FIGS. 21A and 21B, the protrusion 62 may be configured to extend from the binding machine main body 5. Thereby, it is possible to securely mount the protrusion 62 by using the binding machine main body 5, and to cover and protect the substantially entire curl guides 21, 22 by the protection part 71.

(Effect 17)

As shown in each embodiment of FIGS. 5 to 21B, the protrusion 62 may be mounted to at least one side surface of the outer surfaces of the curl guides 21, 22. Thereby, it is possible to simply mount the protrusion 62 from the outside of the curl guides 21, 22, and to efficiently protect the outer side of the curl guides 21, 22. Also, it is possible to more simply mount and demount the protection part 71.

(Effect 17-1)

As shown in the embodiment of FIGS. 22A to 22C, the protrusion 62 may be mounted inside the curl guides 21, 22. Thereby, it is possible to make the protection part 71 small. Also, it is possible to provide the protrusion 62 without increasing an outer shape of the curl guides 21, 22. Furthermore, it is possible to mount the protrusion 62 by using a component and the like provided inside the curl guides 21, 22.

In the meantime, the protrusion 62 mounted inside the curl guides 21, 22 may be provided with a configuration (for example, a detachable structure, a displaceable structure, the protection part 71, the mark 81 and the like) similar to the protrusion 62 mounted outside the curl guides 21, 22.

(Effect 18)

According to the auxiliary member 61 for binding machine of the embodiment, it is possible to achieve the operational effects similar to the binding machine 1.

Although the embodiments have been described in detail with reference to the drawings, the embodiments are just exemplary. Therefore, the disclosure is not limited to the embodiments, and design changes and the like made without departing from the gist are also included in the disclosure. Also, for example, when a plurality of configurations is included in each embodiment, possible combinations of the configurations are also included in the disclosure even though there are no specific descriptions. Also, when a plurality of embodiments or modified embodiments are disclosed, possible combinations of the configurations thereof are included in the disclosure even though there are no specific descriptions. Also, the configurations shown in the drawings are included in the disclosure even though there are no specific descriptions. Further, the terms "and the like" are used as meanings including the equivalents. Also, the terms "substantially", "approximately", "about", and the like are used as meanings including ranges and precisions commonsensically recognized.

1: binding machine
5: binding machine main body
6: binding target
9: wire
21: curl guide
22: curl guide
24: twisting part
25: shaft
25*a*: extension line
31: locus
32: outer periphery-side surface
33: side surface
34: side surface
61: auxiliary member for binding machine
62: protrusion
62*a*: outer periphery constituting surface
62*b*: side constituting surface
63: contact surface
64: guide part
64*a*: linear guide part
64*b*: concavo-convex guide part
64*c*: two-point-like guide part
64*d*: curved guide part
65: guide part
65*a*: part positioned outside
65*b*: part positioned inside
65*c*: tip end portion
65*p*: boundary part
71: protection part
73: protection surface
73*a*: outer periphery protection surface
73*b*: side surface protection surface
75: width-narrowed part
81: mark
81*a*: projection portion
81*b*: concave portion
85: mounting member

The invention claimed is:

1. A binding machine comprising:

a curl guide configured to guide a wire in a loop shape around a binding target, and a twisting part configured to bind the binding target by twisting the wire guided in the loop shape around the binding target, wherein the curl guide has a tapered protrusion at a tip end-side, wherein the tapered protrusion has a guide part provided on an outer periphery-side of the protrusion and arranged substantially perpendicularly to an extension line of a shaft of the twisting part, wherein the tapered protrusion has a pointed tip end, and wherein the tapered protrusion is provided at an inner periphery-side, which is opposite to the guide part, with an inclined guide part configured to guide the binding target from a tip end side toward a base end-side.

2. The binding machine according to claim 1, wherein the guide part is configured as a planar surface.

3. The binding machine according to claim 1, wherein the guide part includes a planar surface and a convex portion protruding from the planar surface.

4. The binding machine according to claim 1, wherein the guide part is configured as a curved surface proximate to a planar surface.

5. The binding machine according to claim 1, wherein the tapered protrusion has an outer periphery constituting surface forming an outer periphery-side surface of the tapered protrusion, and the outer periphery constituting surface has a width-narrowed part in which a width decreases toward a tip end-side.

6. The binding machine according to claim 5, wherein the tapered protrusion has a pair of side constituting surfaces configuring side surfaces of the tapered protrusion, and the width-narrowed part has a shape tapered toward one side constituting surface.

7. The binding machine according to claim 1, wherein the tapered protrusion has a side constituting surface configuring a side surface of the tapered protrusion, and the side constituting surface has a shape tapered toward a tip end-side.

8. The binding machine according to claim 1, wherein the tapered protrusion has a mark indicative of a position, through which the wire is to pass, on an outer periphery-side or inner periphery-side surface.

9. The binding machine according to claim 1, wherein the guide part includes a planar surface and a concave portion recessed from the planar surface.

10. The binding machine according to claim 1, wherein the curl guide includes an upper curl guide and a lower curl guide, and the tapered protrusion is provided to the upper curl guide.

11. The binding machine according to claim 10, wherein the upper curl guide is fixed to the binding machine main body.

12. The binding machine according to claim 11, wherein the tapered protrusion is detachably mounted to the upper curl guide.

13. The binding machine according to claim 11 comprising a protection part configured to be continuous to the tapered protrusion, and the protection part covers at least a part of outer surfaces of the upper curl guide.

14. The binding machine according to claim 11, wherein the tapered protrusion is provided on at least one side surface of the upper curl guide.

15. The binding machine according to claim 1, wherein the curl guide includes an upper curl guide and a lower curl guide, and the tapered protrusion is provided to the lower curl guide.

16. A system comprising an auxiliary member and a binding machine, wherein the auxiliary member is mounted to one of a pair of curl guides of the binding machine and the pair of curl guides are configured to guide a wire in a loop shape around a binding target, wherein the auxiliary member has a tapered protrusion that is positioned at a tip end-side of the curl guide when the auxiliary member is mounted to one of the pair of curl guides, and the auxiliary member is detachably mounted to the one of the pair of curl guides;

wherein the auxiliary member includes an outer periphery and an inner periphery, and two sides extending between the inner periphery and the outer periphery;

the inner periphery includes an inclined part configured to guide the binding target from the tip end-side toward a base end-side;

the outer periphery includes a guide part; and wherein a width direction extends in a direction between the two sides, and wherein the auxiliary member narrows toward a tip end of the auxiliary member in the width direction, and the auxiliary member also narrows toward the tip end of the auxiliary member in a direction extending from the outer periphery to the inner periphery.

17. The system according to claim 16, wherein the tapered protrusion has a guide part at an outer periphery-side, which is arranged substantially perpendicularly to an extension line of a shaft of a twisting part configured to bind the binding target by twisting the wire guided in the loop shape around the binding target.

18. A binding machine comprising:

a binding machine main body;

an upper curl guide and a lower curl guide which are located at a front end portion of the binding machine main body as a pair and which are configured to guide a wire in a loop shape around a binding target, and a twisting part configured to bind the binding target by twisting the wire guided in the loop shape around the binding target, wherein an opening for inserting therein the binding target is formed with a space between tip end portions of the upper and lower curl guides, wherein the opening with the space between the tip end portions of the upper and lower curl guides is always open during a binding operation, and a tapered protrusion is provided at a tip end-side of one of the upper curl guide or the lower curl guide, wherein the tapered protrusion is provided to the upper curl guide, wherein the upper curl guide is fixed to the binding machine main body, and wherein the tapered protrusion is mounted such that it is displaceable relative to the upper curl guide.

* * * * *